US009334082B2

(12) United States Patent
D'Anglade

(10) Patent No.: US 9,334,082 B2
(45) Date of Patent: May 10, 2016

(54) RECYCLABLE COMPOSITE CONTAINER

(75) Inventor: Pierre-Michel D'Anglade, Ville Mont-Royal (CA)

(73) Assignee: Abzac Canada Inc., Drummondville (Quebec) (CA)

( * ) Notice: Subject to any disclaimer, the term of this patent is extended or adjusted under 35 U.S.C. 154(b) by 136 days.

(21) Appl. No.: 13/817,411

(22) PCT Filed: Aug. 16, 2011

(86) PCT No.: PCT/CA2011/000935

§ 371 (c)(1),
(2), (4) Date: Feb. 15, 2013

(87) PCT Pub. No.: WO2012/021975

PCT Pub. Date: Feb. 23, 2012

(65) Prior Publication Data

US 2013/0140306 A1 Jun. 6, 2013

Related U.S. Application Data

(60) Provisional application No. 61/374,361, filed on Aug. 17, 2010.

(51) Int. Cl.
*B65D 8/00* (2006.01)

(52) U.S. Cl.
CPC ..... *B65D 15/04* (2013.01); *B65D 15/08* (2013.01)

(58) Field of Classification Search
CPC ..... B65D 15/08; B65D 15/04
USPC ..... 220/4.28, 4.33, 4.34, 784, 320, 640, 220/642, 643, 648, 649, 654, 495.06, 220/495.08, 495.11
See application file for complete search history.

(56) References Cited

U.S. PATENT DOCUMENTS 2,727,673 A * 12/1955 Bergstrom ..... 229/164.2
3,127,052 A 3/1964 Mayers (Continued)

FOREIGN PATENT DOCUMENTS

DE 7634803 U1 5/1977
EP 0410938 A1 1/1991

(Continued)

OTHER PUBLICATIONS

International Search Report mailed Nov. 17, 2011, which issued in corresponding International Application No. PCT/CA2011/000935.

(Continued)

*Primary Examiner* — Fenn Mathew
*Assistant Examiner* — Robert Stodola
(74) *Attorney, Agent, or Firm* — Fish & Richardson P.C.

(57) ABSTRACT

A recyclable composite container is provided. The recyclable composite container comprises a cardboard hollow body having an open end defining an opening, the body being formed by a sidewall having inner and outer surfaces, the sidewall being provided with an aperture at a distance from the open end. The recyclable composite container also comprises a framing element removably connectable to the open end having a collar sized and shaped for snugly fitting over said open end; and a resilient arm extending from the collar, the arm extending along the inner surface of the sidewall and having a projection sized and shaped to be removably fitted in the aperture of the sidewall of the hollow body. This construction allows connection of the framing element to the cardboard hollow body by fitting the projection of the resilient arm in the aperture of the hollow body, and disconnection of the framing element from the cardboard hollow body by pressing the projection to disengage the projection from the aperture and by pulling the framing element away from the cardboard hollow body.

15 Claims, 29 Drawing Sheets

(56) References Cited

U.S. PATENT DOCUMENTS

| | | | | | |
|---|---|---|---|---|---|
| 3,161,345 | A | | 12/1964 | William | |
| 3,223,278 | A | * | 12/1965 | Allen | 220/320 |
| 3,730,382 | A | | 5/1973 | Heisler | |
| 3,753,511 | A | | 8/1973 | Ruch | |
| 3,770,156 | A | | 11/1973 | Yates | |
| 3,792,797 | A | | 2/1974 | Mrusek et al. | |
| 3,815,778 | A | | 6/1974 | Martin | |
| 3,817,420 | A | | 6/1974 | Heisler | |
| 3,913,774 | A | * | 10/1975 | Vajtay | 220/4.01 |
| 3,915,336 | A | | 10/1975 | Spreng | |
| 3,973,719 | A | | 8/1976 | Johnson et al. | |
| 4,266,686 | A | | 5/1981 | Carter | |
| 4,267,928 | A | * | 5/1981 | Curry, Jr. | 206/583 |
| 4,280,653 | A | | 7/1981 | Elias | |
| 4,312,459 | A | * | 1/1982 | Leach | 220/256.1 |
| 4,491,238 | A | | 1/1985 | Tobolt | |
| 4,518,097 | A | | 5/1985 | Milton et al. | |
| 4,582,707 | A | | 4/1986 | Calabro | |
| 4,676,392 | A | | 6/1987 | Giggard et al. | |
| 4,679,699 | A | | 7/1987 | Malsbury et al. | |
| 4,700,867 | A | | 10/1987 | Dutt et al. | |
| 4,718,571 | A | | 1/1988 | Bordner | |
| 4,741,453 | A | * | 5/1988 | Stolzman | 220/315 |
| 4,856,708 | A | | 8/1989 | Giasi | |
| 4,993,623 | A | * | 2/1991 | Kelly et al. | 229/122.29 |
| 5,035,387 | A | | 7/1991 | Gizzi | |
| 5,160,063 | A | | 11/1992 | Bailey | |
| 5,161,689 | A | | 11/1992 | Balson | |
| 5,246,134 | A | | 9/1993 | Roth et al. | |
| 5,295,632 | A | | 3/1994 | Zink et al. | |
| 5,316,169 | A | | 5/1994 | Gallagher | |
| 5,443,853 | A | | 8/1995 | Hayes | |
| 5,669,550 | A | | 9/1997 | Klemme et al. | |
| 5,730,352 | A | * | 3/1998 | Deekes | 229/4.5 |
| 5,794,814 | A | | 8/1998 | Baerenwald | |
| 5,806,710 | A | | 9/1998 | Shiffer et al. | |
| 5,950,861 | A | | 9/1999 | Roth et al. | |
| 6,220,471 | B1 | | 4/2001 | Lowry | |
| 6,250,492 | B1 | | 6/2001 | Verbeek et al. | |
| 6,401,952 | B1 | * | 6/2002 | Ming | 220/4.09 |
| 6,616,110 | B1 | | 9/2003 | McIntee | |
| 6,675,971 | B2 | | 1/2004 | Case | |
| 6,964,348 | B2 | | 11/2005 | Breimon et al. | |
| 7,311,218 | B2 | | 12/2007 | Varadarajan | |
| 7,350,789 | B2 | | 4/2008 | Uffner et al. | |
| 7,581,671 | B2 | | 9/2009 | Erdi | |
| 7,703,626 | B2 | | 4/2010 | Witt | |
| 8,181,847 | B1 | * | 5/2012 | Erdie | 229/102 |
| 2003/0070949 | A1 | | 4/2003 | Harris | |
| 2007/0145082 | A1 | * | 6/2007 | Parve | 222/480 |
| 2009/0159607 | A1 | | 6/2009 | Kratzer | |
| 2009/0283526 | A1 | | 11/2009 | Pierce et al. | |
| 2010/0084361 | A1 | * | 4/2010 | Dayton et al. | 215/40 |
| 2011/0056976 | A1 | | 3/2011 | Chen | |
| 2011/0108553 | A1 | * | 5/2011 | Pantelleria | 220/319 |

FOREIGN PATENT DOCUMENTS

| | | | |
|---|---|---|---|
| EP | 0952087 | A2 | 10/1999 |
| EP | 1081051 | A1 | 3/2001 |
| EP | 1092526 | A1 | 4/2001 |
| EP | 1092647 | A2 | 4/2001 |
| EP | 1104744 | A2 | 6/2001 |
| FR | 2305362 | A1 | 10/1976 |
| FR | 2540078 | A1 | 8/1984 |
| GB | 2235920 | A | 2/1991 |
| WO | 9747525 | A1 | 12/1997 |
| WO | 2010030958 | A2 | 3/2010 |

OTHER PUBLICATIONS

Written Opinion mailed Nov. 17, 2011, which issued in corresponding International Application No. PCT/CA2011/000935.

Supplementary European Search Report dated May 15, 2015 which issued in corresponding European Patent Application No. 11817608.0.

* cited by examiner

RECYCLABLE COMPOSITE CONTAINER

CROSS REFERENCE TO PRIOR APPLICATIONS

This is a U.S. National Phase application under 35 U.S.C. §371 of International Patent Application No. PCT/CA2011/000935, filed Aug. 16, 2011, and claims the benefit of U.S. Provisional Patent Application Ser. No. 61/374,361, filed Aug. 17, 2010 both of which are incorporated by reference herein in their entirety. The International Application published in English on Feb. 23, 2012 as WO 2012/021975 under PCT Article 21(2).

FIELD OF THE INVENTION

The present invention generally relates to packaging and more particularly relates to a composite container system which can be disassembled and the components thereof recycled.

BACKGROUND

Packaging, such as box-shaped containers, are normally made entirely from a single material such as metal, plastic, wood or cardboard. Also known are composite containers made from combinations of either metal and plastic or metal and cardboard. When an impervious or leak-proof container is required for substances such as paint, toxic or harmful chemical products and the like, which may include volatile or other chemically active components, the containers are generally made entirely of a single material such as metal or plastic because these materials enable the containers to be made both leak-proof and structurally rigid.

The known composite containers typically comprise cardboard tubes closed at either end with metal end framing structures. The peripheral edges of these end framing structures are typically joined to the cardboard tube by a crimping or seaming process wherein the edge of the end framing structure is bent around one of the cylinder's extremities, thereby permanently deforming and connecting both the end framing structure and the cylinder's extremity. The crimping can also retain a metallised liner which is provided along the interior surface of the cardboard cylinder.

U.S. Pat. No. 4,312,459 describes a paint can rim cover and a lid, the rim cover being used to prevent paint from drying within the groove of the rim of a paint can of well-known construction. A typical paint can is formed of a cardboard cylinder having its upper end, which is outwardly rolled, and a metallic rim rolled and crimped around the outwardly rolled end of the cardboard cylinder. The connection between the cardboard cylinder and the metallic rim is made so as to be permanent. The plastic rim cover of the invention is destined to cooperate with the metallic rim of the paint can and has a lip which cooperates with the bead of the metallic rim.

Also known to the Applicant is document U.S. Pat. No. 3,792,797, describing a cover-closure for containers with a relatively large opening. The annular rim of the container is provided with alternating locking cams and depressions, and the cover is provided with corresponding cut-outs and cover-segments. When the cover is secured to the container, the cover-segments grip the depressions of the container, and the cut-outs are aligned with the locking cams. A band-shaped tensioning ring is used to tension the cover-segments in place, thus securing the cover over the container.

U.S. Pat. No. 3,913,774 describes a container having a tubular central section forming sides and rigid end caps in positive engagement. The sides have perforations near the rims and the rigid end caps have engaging means consisting of a first portion for inserting the perforations and a second portion for preventing the disengagement of the perforations for the first portion.

U.S. Pat. No. 7,581,671 describes a shipping container of the type that is often used to ship large format papers and photos. The shipping container includes a paper tube and an end cap. The paper tube is provided with a mounting opening and the cap with a projection which can extend into the opening when the cap is pressed into the open end of the tube. The cap can be removed from the container by rotating the end cap relative to the tube.

Also known in the art or in related fields of the art are the following documents: U.S. Pat. No. 3,127,052; U.S. Pat. No. 3,815,778; U.S. Pat. No. 3,973,719; U.S. Pat. No. 4,280,653; U.S. Pat. No. 5,160,063; U.S. Pat. No. 5,669,550; U.S. Pat. No. 6,250,492; U.S. Pat. No. 6,675,971; U.S. Pat. No. 7,311,218; U.S. Pat. No. 7,703,626; EP0952087, EP1081051, EP1092526, EP1092647; EP 1104744; US 2009/0283526; WO97/47525; WO2010/030958; GB 2235920; U.S. Pat. No. 3,730,382; U.S. Pat. No. 3,753,511; U.S. Pat. No. 3,770,156; U.S. Pat. No. 3,792,797; U.S. Pat. No. 3,817,420; U.S. Pat. No. 3,915,336; U.S. Pat. No. 4,266,686; U.S. Pat. No. 4,312,459; U.S. Pat. No. 4,491,238; U.S. Pat. No. 4,518,097; U.S. Pat. No. 4,676,392; U.S. Pat. No. 4,679,699; U.S. Pat. No. 4,582,707; U.S. Pat. No. 4,700,867; U.S. Pat. No. 4,718,571; U.S. Pat. No. 4,856,708; U.S. Pat. No. 5,035,387; U.S. Pat. No. 5,161,689; U.S. Pat. No. 5,246,134; U.S. Pat. No. 5,295,632; U.S. Pat. No. 5,316,169; U.S. Pat. No. 5,443,853; U.S. Pat. No. 5,794,814; U.S. Pat. No. 5,806,710; U.S. Pat. No. 5,950,861; U.S. Pat. No. 6,220,471; U.S. Pat. No. 6,616,110; U.S. Pat. No. 6,964,348; U.S. Pat. No. 7,350,789; U.S. Pat. No. 7,350,789; U.S. Pat. No. 7,703,626; US 20090159607; and US 20110056976.

A drawback of some of the prior composite containers is that, once assembled, these containers cannot be easily disassembled, making recycling of their various components very difficult. As for containers which can be easily disassembled, the connection of the cap with the body of the container is in most cases not strong enough to resist shocks and the frequent handling of the container.

It would therefore be desirable to provide a composite container system which can overcome this disadvantage.

It would also be desirable to provide a container system which can be dissembled and then recycled, at least partly, and that would also be versatile, lightweight, inexpensive and/or easily manufactured.

SUMMARY OF THE INVENTION

In accordance with the present invention, a recyclable composite container is provided. The recyclable composite container comprises a cardboard hollow body having an open end defining an opening. The body is formed by a sidewall having inner and outer surfaces, and the sidewall is provided with an aperture at distance from the open end. The container also comprises a framing element removably connectable to the open end. The framing element has a collar sized and shaped for snugly fitting over the open end, and a resilient arm extending from the collar. The arm is for extending along the inner surface of the sidewall and has a projection sized and shaped to be removably fitted in the aperture of the sidewall of the hollow body. The connection of the framing element to the cardboard hollow body is allowed by fitting the projection of the resilient arm into the aperture of the hollow body, and the disconnection of the framing element from the cardboard hollow body is allowed by pressing the projection to disengage the projection from the aperture and by pulling the framing element away from the cardboard hollow body.

By composite container, it is meant the container is made of different parts and/or different materials.

By framing element, it is meant an element substantially rigid to provide rigidity and structure to the cardboard hollow body.

The expression "removably connectable" refers to the framing element rather than to a lid, and is intended to mean that when applying a predetermined amount of pressing force on the projections of the framing element, the framing element can be disengaged from the cardboard body.

BRIEF DESCRIPTION OF THE DRAWINGS

Other objects, advantages and features of the present invention will become more apparent upon reading the following non-restrictive description of preferred embodiments thereof, given for the purpose of exemplification only, with reference to the accompanying drawings in which.

DESCRIPTION OF PREFERRED EMBODIMENTS

Figure 1:
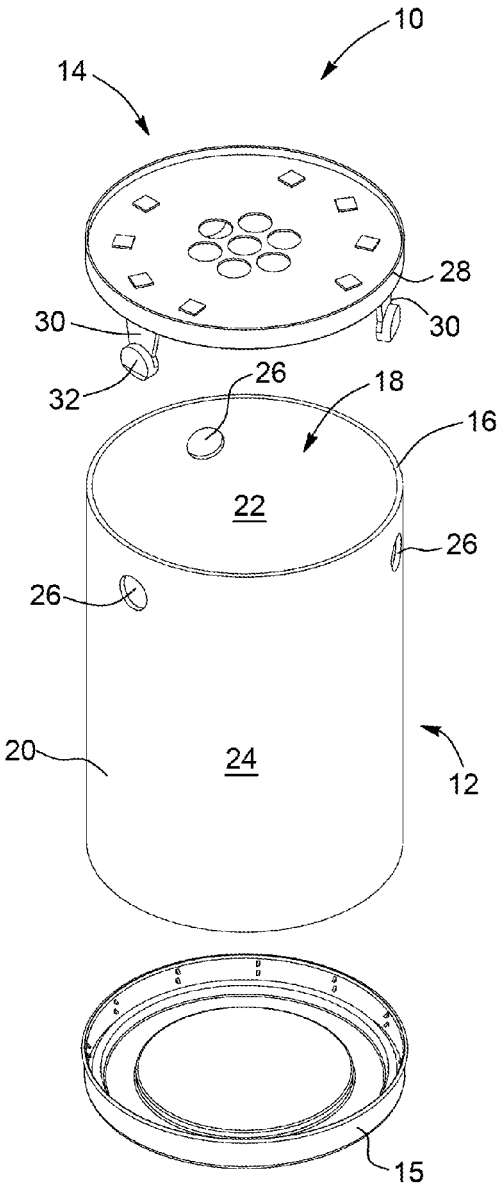
FIG. 1 is an exploded view of a container according to a first preferred embodiment of the invention.

In the following description, similar features in the drawings have been given similar reference numerals. In order to preserve clarity, certain elements may not be identified in some figures if they are already identified in a previous figure. It will be appreciated that positional descriptions such as "top", "bottom" and the like should, unless otherwise indicated, be taken in the context of the figures and should not be considered limiting.

Figure 1A:
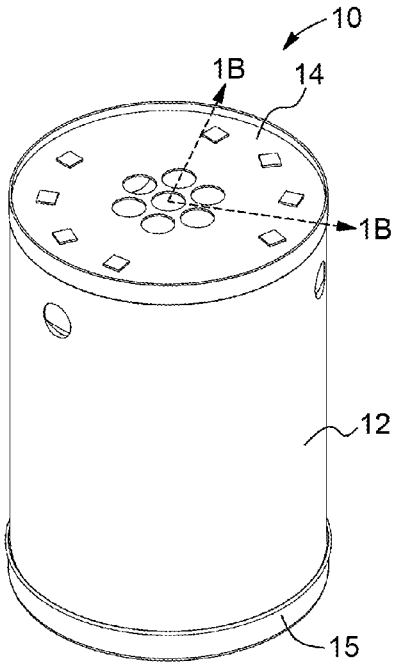
FIG. 1A is a top perspective view of the container of FIG. 1, shown assembled.
Figure 1B:
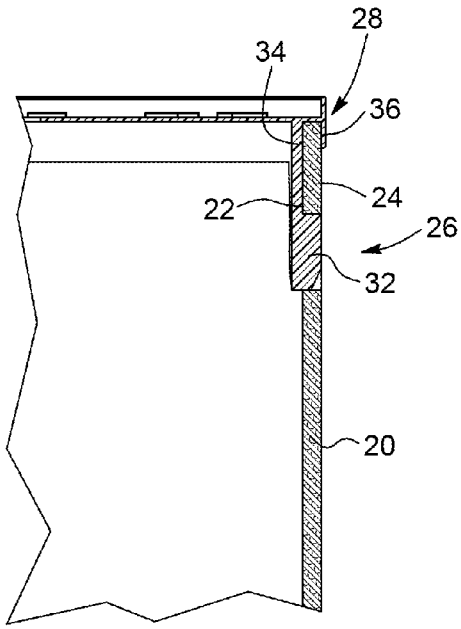
FIG. 1B is a partial cross-sectional view of FIG. 1A, taken along line 1B-1B.

With reference to FIGS. 1, 1A and 1B, a recyclable composite container 10 is shown. The container 10 includes a framing element 14 and a cardboard hollow body 12. The cardboard hollow body 12, which in this case has a cylindrical shape though is not necessarily limited to such a shape, is provided with an open end 16, which defines an opening 18. The cardboard body 12 is formed by a sidewall 20 having inner and outer surfaces 22, 24. The sidewall 20 is provided with at least one aperture 26 at distance from the open end 16. In this variant of the container 10, the cardboard hollow body 12 is provided with three apertures 26. While the hollow body 12 is shown here with a tubular shape, the hollow body may have any shape of cross-section such as circular, rectangular, square, triangular, or oval.

The framing element 14 reinforces the open end 16 of the cardboard body 12, and is removably connectable to it. By "removably connectable", it is meant that the framing element can be connected and disconnected from the body 12. The framing element 14 has a collar 28 size and shape for snuggly fitting over the open end 16 of the body 12 (best shown in FIG. 1B), and at least one resilient arm 30 which extends from the collar. The arm 30 extends downward of the lower periphery of the collar 28, providing the arm 30 with flexibility and resiliency required to be pressed in and out of the aperture 26. It also allows the collar 28 to be kept narrow at the open end 16 of the body 12. In this embodiment, the framing element 14 is provided with three resilient arms 30, only two being visible in FIG. 1. Best shown in FIG. 1B, each of the arms 30 extends along the inner surface 22 of the sidewall 20 of the cardboard hollow body 12. The arm 30 is provided with a projection 32 which is sized and shaped to be removably fitted in the corresponding aperture 26 of the sidewall 20 of the cardboard hollow body 12. The projection 32 extends radially outward from the arm 30, that is, it projects on the outer surface 24 of the cardboard body 12 when the container 10 is assembled. As it can be appreciated, the size of the projection 32 and aperture 26 closely match, allowing the projection 32 to be retained by friction into the aperture 26, preferably on the entire side edge of the projection 32. It is also possible, to form the projection 32 with a size slightly larger than the size of the aperture 26, such that the projection 32 compresses the portion of the cardboard bounding the aperture 26, creating a stronger connection between the framing element 14 and the body 12. When assembled, the outer face of the projection 32 is preferably flush with the outer surface 24 of the cardboard cylinder 12.

As shown in FIGS. 1 and 1A, a bottom cap or cover 15 is used to close off the bottom opening of the cardboard hollow body 12.

As it can be appreciated, the connection of the framing element 14 to the cardboard hollow body 12 is made by fitting the projections 32 of the resilient arms 30 in the apertures 26 of the hollow body 12. When the container 10 is empty, the framing element 14 is preferably disconnected from the cardboard hollow body 12 by pressing the projections 32 so as to disengage the projections 32 from the corresponding apertures 26, and by then pulling the framing element 14 away from the cardboard hollow body 12. The pressing force is applied radially on the projection, inwardly, or in other words, towards the inside of the container 10. This pressure can be applied manually, by pressing fingers on the projections. The framing element 14, for example being made of plastic or metal, and the hollow body 12, made of cardboard, can thus be recycled or re-used. Of course, the bottom cap 15 would also need to be pulled off the bottom opening. The entire composite container 10 can thus be completely recycled by disassembling the framing element 14 and cover 15 from the cardboard hollow body 12. This particular construction of the container 10 allows a connection of its main components which is sturdy enough for general use and yet simple to disassemble, so as to facilitate the recycling of the materials forming the container 10.

Of course, the framing element 14 could include a different number of resilient arms 30 extending along the collar 28, and the cardboard hollow body 12 could have an equal number of apertures 26. In other words, container can be provided with a plurality of resilient arms and apertures, each of the resilient arms fitting in a corresponding one of the apertures when the framing element is connected to the cardboard hollow body.

Figure 2A:
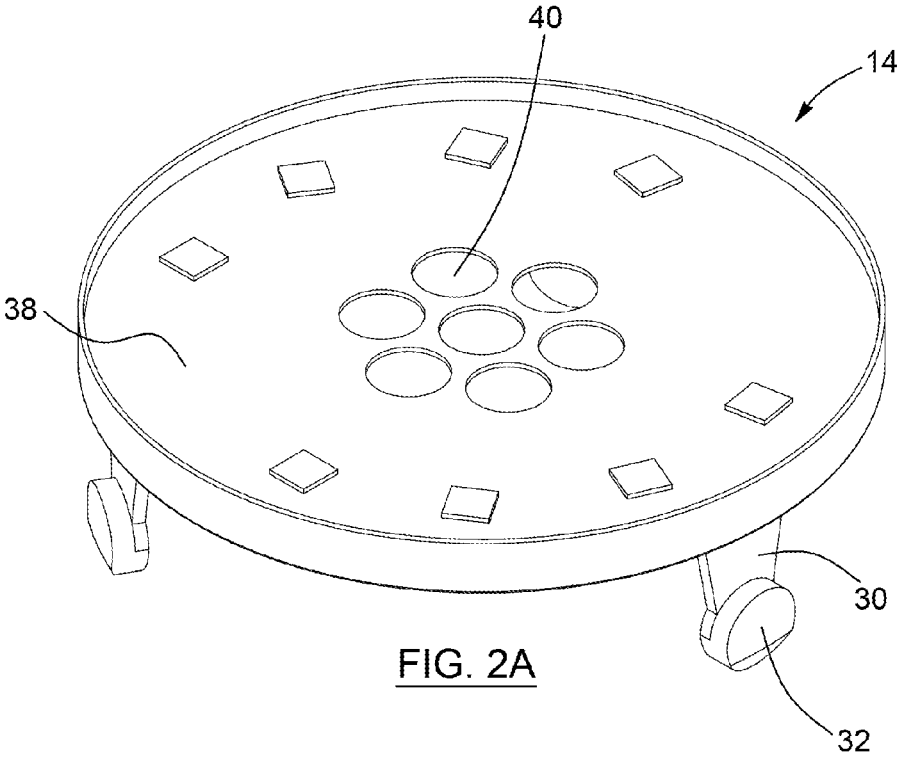
FIG. 2A is a top perspective view of a framing element according to a first variant.
Figure 2B:
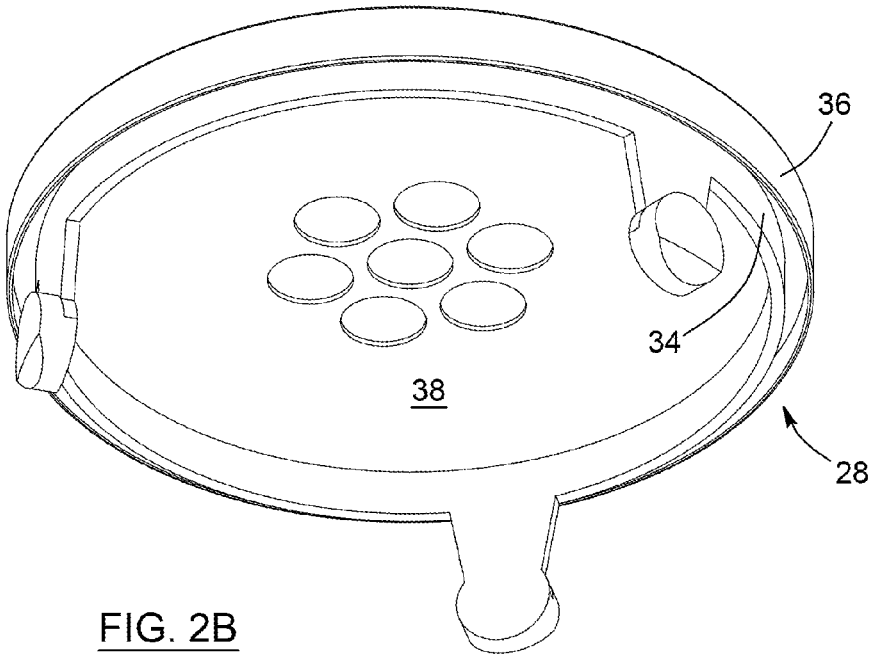
FIG. 2B is a bottom perspective view of the framing element of FIG. 2A.
Figure 2C:
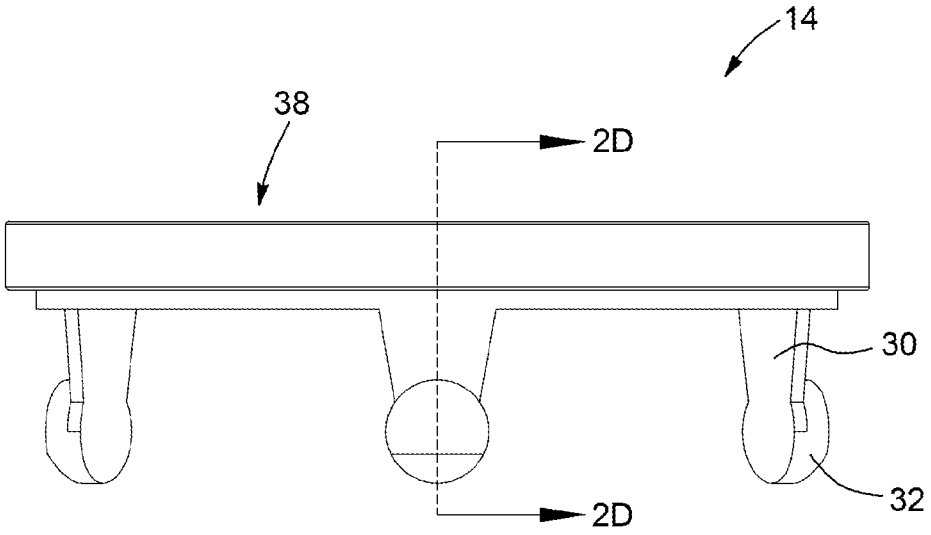
FIG. 2C is a side view of the framing element of FIG. 2A.
Figure 2D:
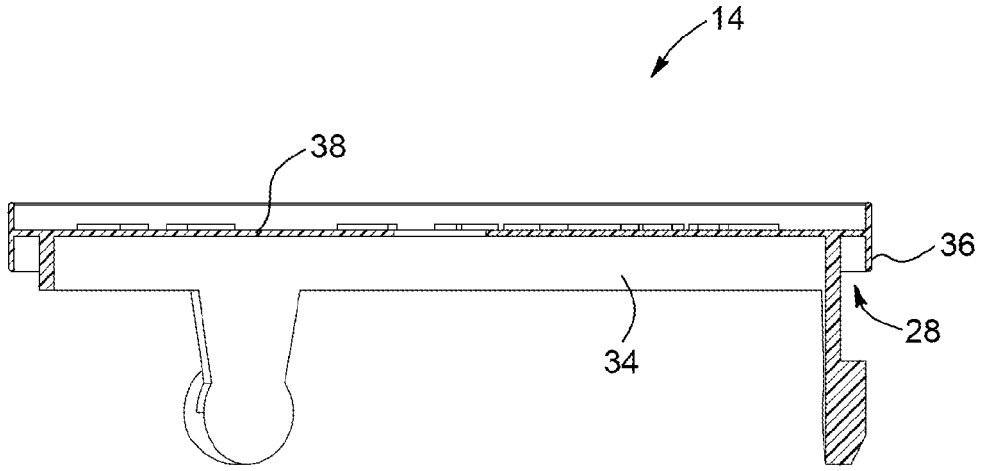
FIG. 2D is a cross-sectional view of the framing element of FIG. 2C, taken along line 2D-2D.

Now referring to FIGS. 2A to 2D, the framing element 14 of FIG. 1 will be described more in detail. As shown in FIG. 2D, the collar 28 has a U-shaped cross-section comprising parallel inner and outer walls 34, 36 which are for clamping the open end of the cardboard hollow body on both its inner and outer surfaces when the framing element 14 is connected to the cardboard hollow body. The framing element 14 is also provided with a cover wall 38 which is integral to the collar 33. The cover wall 38 is perforated with holes 40 to allow a substance contained within the container, such as powder for example, to be poured or expelled out of the container. Of course, the cover wall 38 can also not include these holes 40, for example as when the objective is to simply close off the container. The protrusions 32 have a tapered section at the bottom side, that is, they are narrower in their lower portion, to ease the insertion and removal of the protrusions 32 from the corresponding apertures.

Figure 3A:
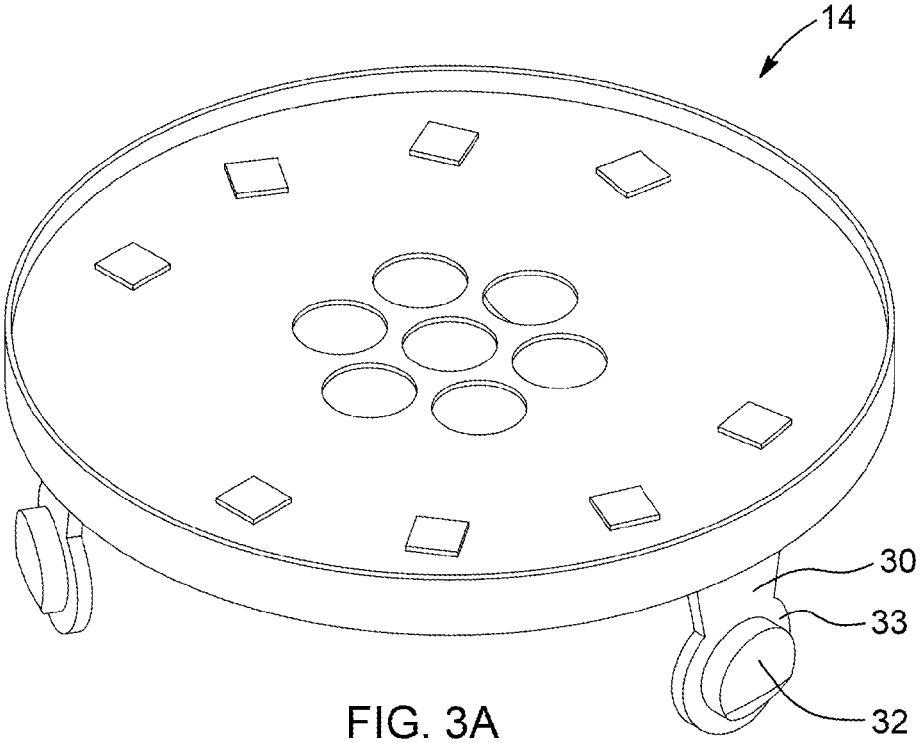
FIG. 3A is a top perspective view of a framing element, according to a second variant.
Figure 3B:
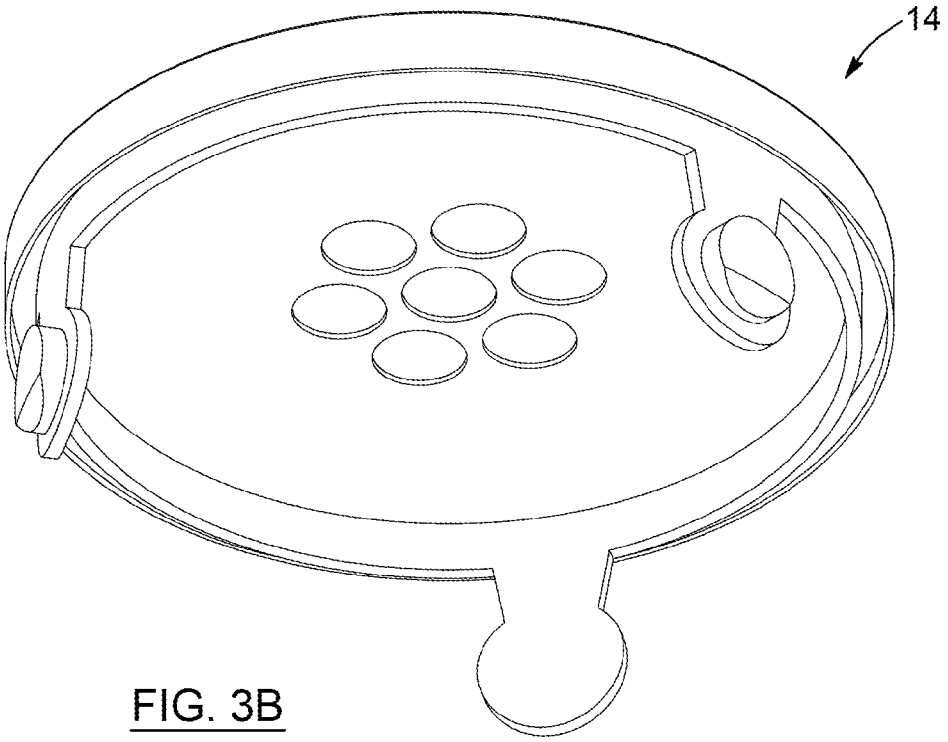
FIG. 3B is a bottom perspective view of the framing element of FIG. 3A.

Now referring to FIGS. 3A and 3B, a second variant of a framing element 14 is shown. In this variant, a portion of the resilient arm 30 surrounds the protrusion 32, allowing the arm 30 to provide a more sturdy and robust connection of the framing element 14 to the body when fitted over the open end. With this particular configuration, the peripheral portion 33 of the resilient arm 30 surrounding the protrusion 32 will conform, or contact the inner surface of the cardboard hollow body when the framing element 14 is connected to the body, reinforcing the connection of these two elements.

Figure 4A:
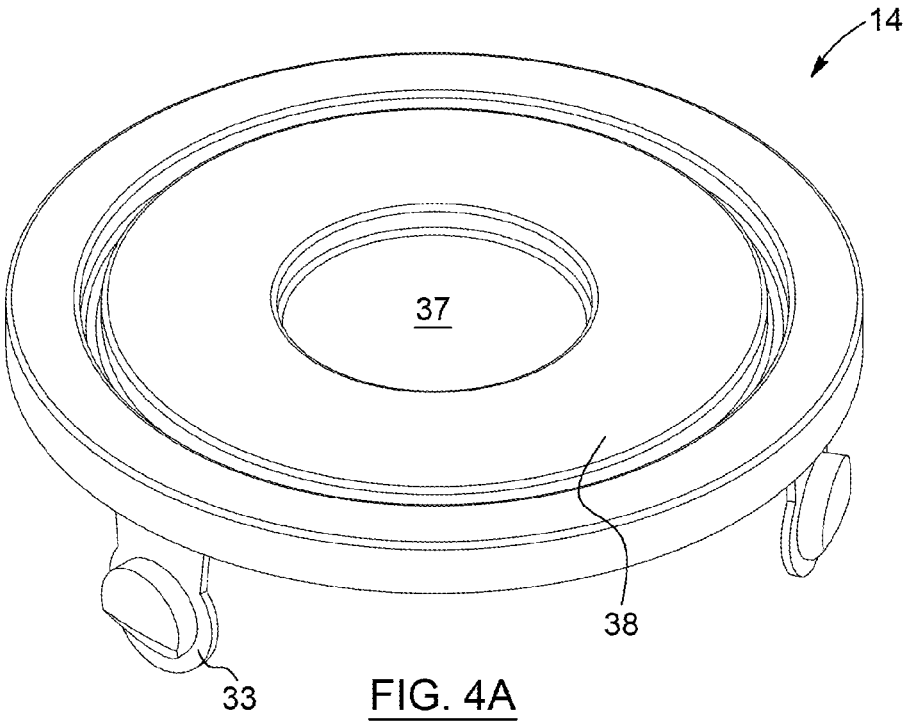
FIG. 4A is a top perspective view of a framing element, according to a third variant.
Figure 4B:
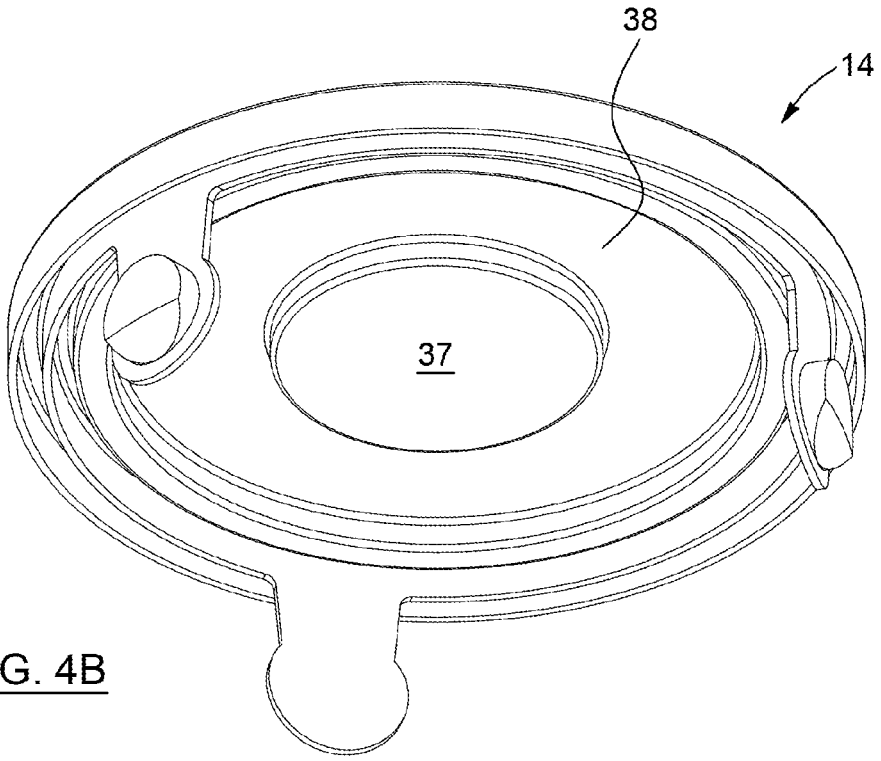
FIG. 4B is a bottom perspective view of the framing element of FIG. 4A.

With reference to FIGS. 4A and 4B, a third variant of a framing element 14 is shown, where in this case, the cover wall 38 is provided with a recess 37, providing the framing element 14 with improved resistance to shocks which may occur during general use of the container 10 or handling thereof.

Turning now to FIGS. 5A to 5D, a second preferred embodiment of the recyclable composite container 10 is shown. The recyclable composite container 10 includes a cardboard hollow body 12 and a framing element 14, and also includes a bag 42, an additional framing element 44 and a lid 46. The bag 42 may be desirable in order to protect the contents of the container 10 from humidity and/or to prevent odours from escaping the container 10. Moreover, the bag 42 can advantageously be used to protect the cardboard cylinder 12, whose main role is to provide structure to the container 10. The presence of the bag 42 will therefore prevent the cardboard cylinder 12 from being damaged when the contents of the container 10 are, for example, liquids. For embodiments where a liquid should be contained within a metallic surface, a metalized bag comprising an interior metallic layer can be used, as is known in the art.

Figure 5A:
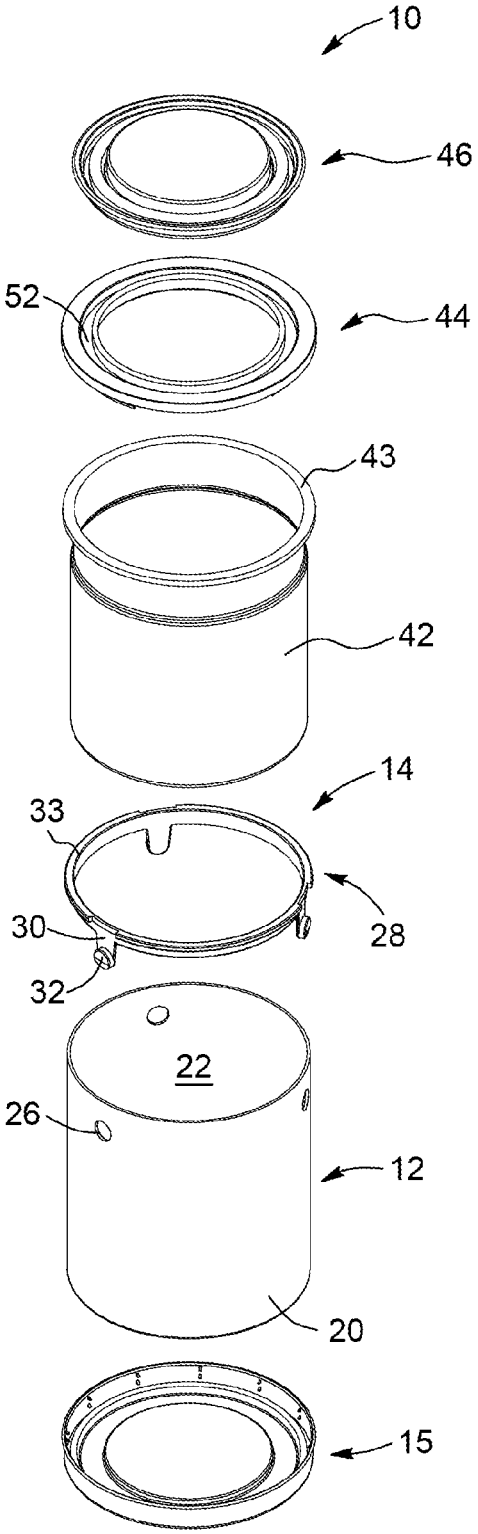
FIG. 5A is an exploded view of a container, according to a second preferred embodiment of the invention.
Figure 5B:
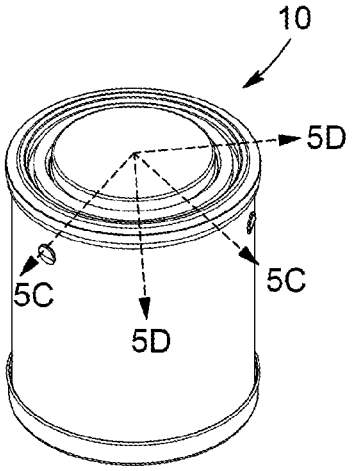
FIG. 5B is a top perspective view of the container of FIG. 5A, shown assembled.

When assembled, such as shown in FIG. 5B, the cover 15 closes off the bottom opening of the cardboard hollow body 12. The framing element 14, the additional framing element 44 and the lid 46 close off the top opening of the body 12. Just as explained for the previous embodiment, during assembly of the container 10, the framing element 14 is first aligned with the top of the cardboard body 12. The former is then pushed into the latter until its top end 16 is received within the collar portion 28 and each projection 32 is received in its corresponding aperture 26. The arms 30 are resilient enough to allow the slight deformation needed and deflect so as not to damage the cardboard body 12. The arm 30 extends along the inner surface 22 of the cardboard body 12, resulting in the projection 32 pointing radially outwards.

Once the framing element 14 is fitted over the cardboard body 12, an impervious bag 42 is placed in the cardboard tube 12 for lining its inner surface 22. Best shown in FIG. 5C, the bag 42 has an open end 43, which is clampable between the framing element 14 and the U-shaped snapping collar 48 of the additional framing element 44. Best shown in FIGS. 5C and 5D, the bag 42 is preferably folded around the framing element 14, so as to improve the imperviousness of the container.

The closed end of the bag 42 can be fixed to a bottom end framing structure or can simply be left loose, extending downwards within the cylinder 12. As such, whatever is stored within the container 10 is sealed within the walls of the bag 42, the framing elements 14, 44, and the lid 46. In addition, it will be appreciated that even if the bag 42 is loose, a desirable vacuum may be created between the bag 42 and the cylinder 12 as the container 10 is assembled and filled. This vacuum will naturally serve to keep the bag 42 tight against the inside of the cylinder 12 even as it is emptied.

Alternatively, a longer bag 42 can be provided which extends not just within the cylinder, but along the outer surface of the cylinder as well. Rather than being clamped between the framing elements 14, 44 at the open end 16, the bag 42 can be clamped at its midpoint. The remainder of the bag, i.e. the portion between its midpoint and open end 43, passes back along the outer surface 24, preferably fitting tightly therearound. The open end 43 is then clamped a second time with lower end framing element 14 or cover 15. Such a bag 42 would therefore be able to both contain a liquid within the container 10 and provide protection for the exterior of the cardboard cylinder 12. The portion of the bag 42 which extends outside the cylinder 12 could be heat-shrunk in order to ensure the tightness of the bag 42 around the outer surface 24.

Figure 5C:
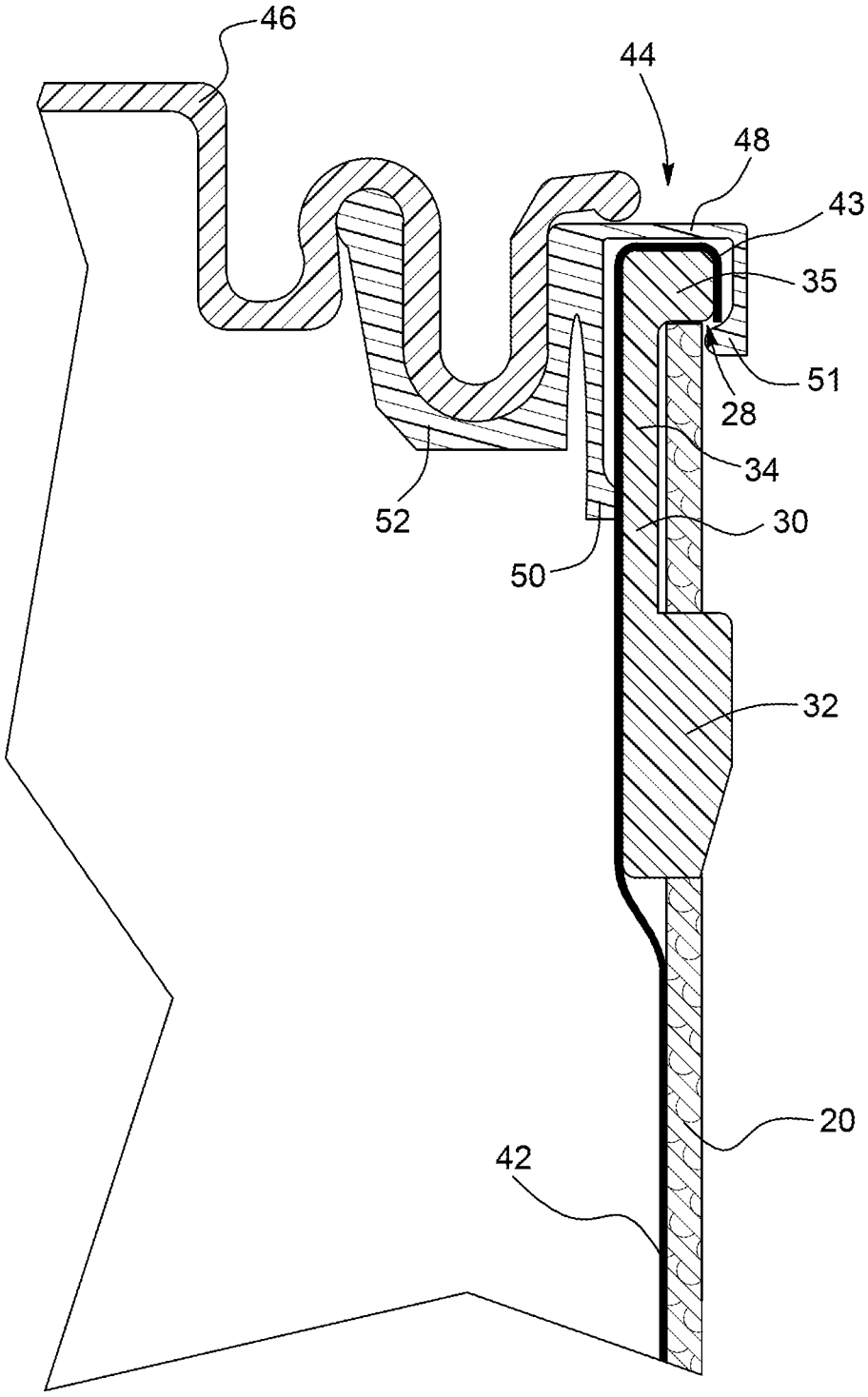
FIG. 5C is a partial cross-sectional view of the container of FIG. 5B, taken along line 5C-5C.
Figure 5D:
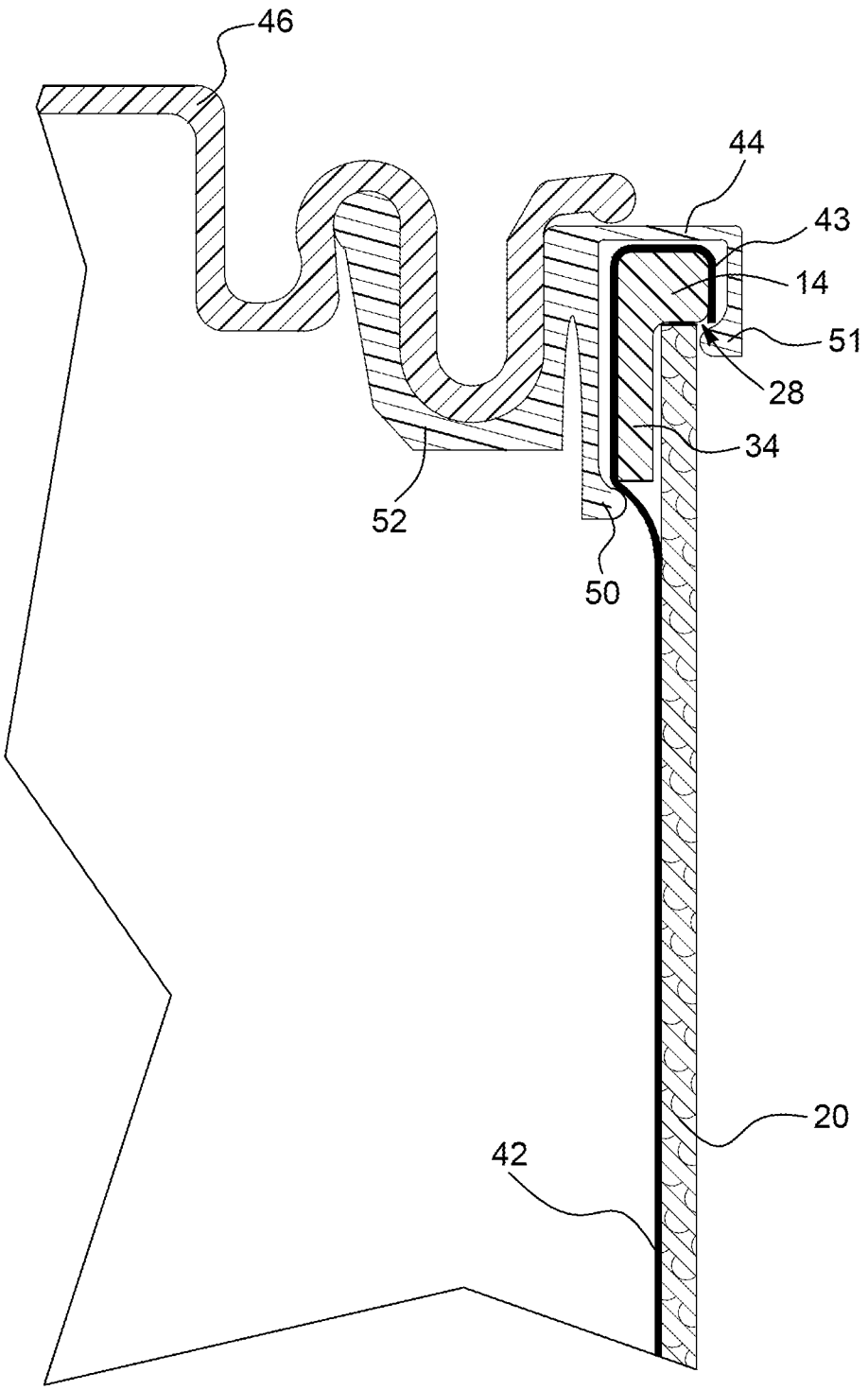
FIG. 5D is a partial cross-sectional view of the container of FIG. 5B, taken along line 5D-5D.
Figure 6A:
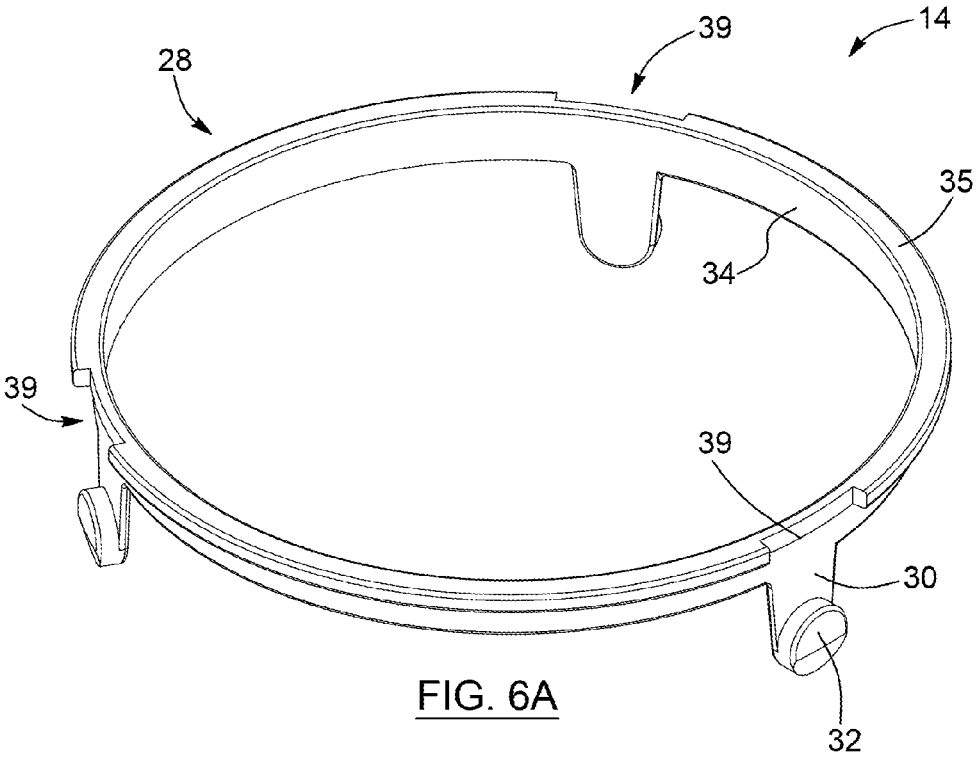
FIG. 6A is a top perspective view of a framing element, according to a fourth variant.
Figure 6B:
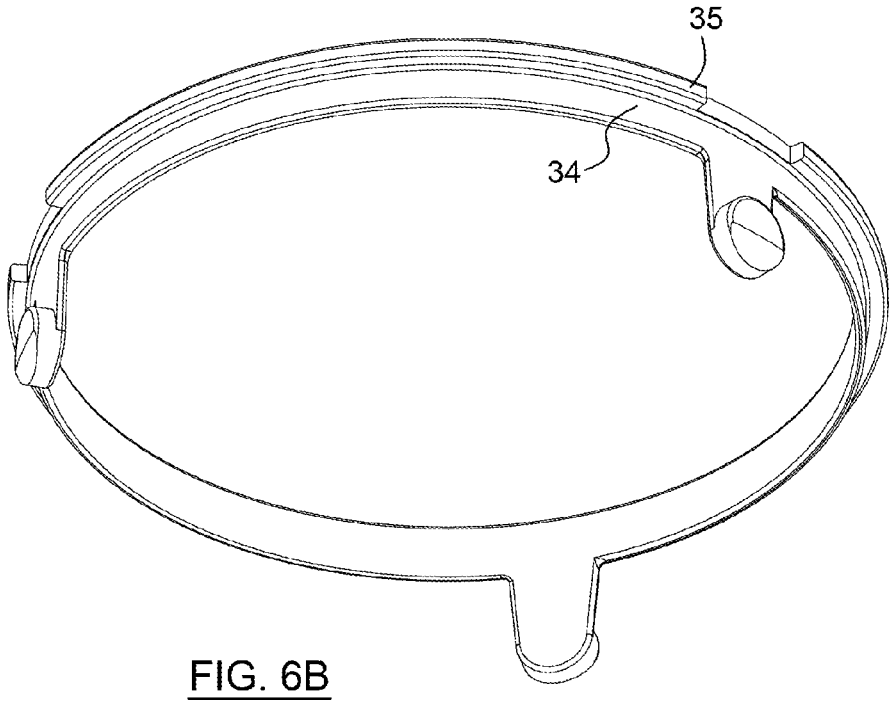
FIG. 6B is a bottom perspective view of the framing element of FIG. 6A.
Figure 6C:
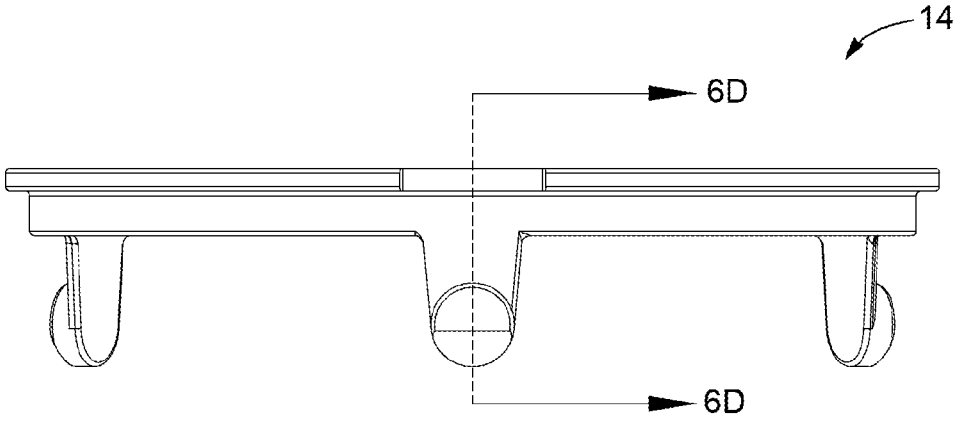
FIG. 6C is a side view of the framing element of FIG. 6A.
Figure 6D:
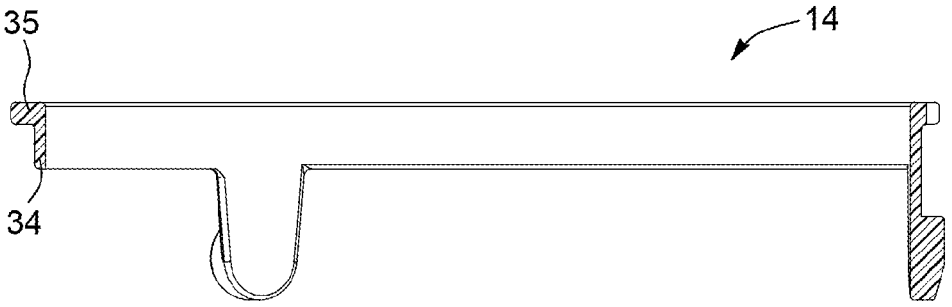
FIG. 6D is a cross-sectional view of the framing element of FIG. 6C, taken along line 6D-6D.

Best shown in FIGS. 5C and 5D, the additional framing element 44 comprises a U-shaped snapping collar 48, which is for snapping over the collar 28 of the framing element 14, when the framing element 14 is connected to the body 12. Of course, the U-shaped snapping collar 48 is sized and shaped such as to snuggly fit over the framing element 44.

Preferably, the additional framing element 44 is provided with a lid receiving flange 52 and a lid 46, which is connectable to the flange 52.

Now referring to FIGS. 6A to 6D, the framing element 14 of FIG. 5A will be described in more detail. The framing element 14 has a peripheral wall 35 for resting on the end surface of the sidewall of the cardboard hollow body. The inner wall 34 extends transversally from the peripheral wall 35, and hugs the inner surface of the sidewall of the cardboard body when the framing element 14 is connected to it. The resilient arms 30 extend from the inner wall 34. Preferably, the peripheral wall 35 is provided with notches 39 which are aligned with the resilient arms 30, to facilitate the molding of the part. The peripheral wall 35 and inner wall 34 are part of the collar 28 of the framing element 14. Best shown in FIG. 6D, the collar 28 has an L-shaped cross-section, and the dimensions of the inner portion of the peripheral wall 35 correspond substantially to the width of the sidewall of the cardboard hollow body.

Referring to FIGS. 7A to 7D, the additional framing element 44 of FIG. 5A is shown. The framing element 44 includes the U-shaped snapping collar 48, having parallel inner and outer walls 53, 54, and locking flanges 50, which in this case are provided on the inner wall 53 of the additional framing element 44. As best shown in FIG. 5D, these locking flanges 50 are interlockable with the collar 28 of the framing element 14. The locking flanges 50 are outwardly curved, so as to snap or interlock underneath the inner wall 34 of the framing element 14.

Figure 7A:
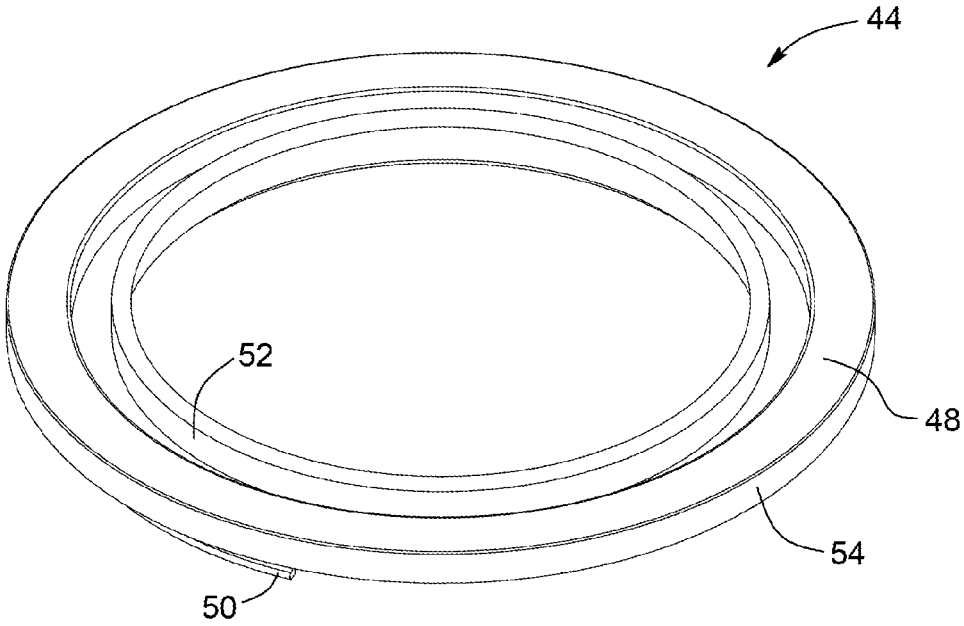
FIG. 7A is a top perspective view of an additional framing element, according to a first variant.
Figure 7B:
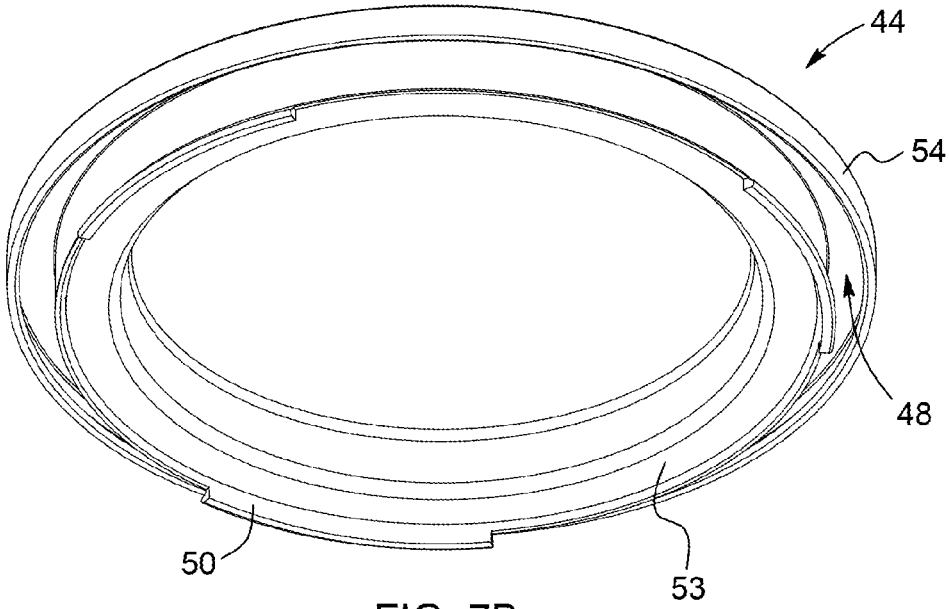
FIG. 7B is a bottom perspective view of the additional framing element of FIG. 7A.
Figure 7C:
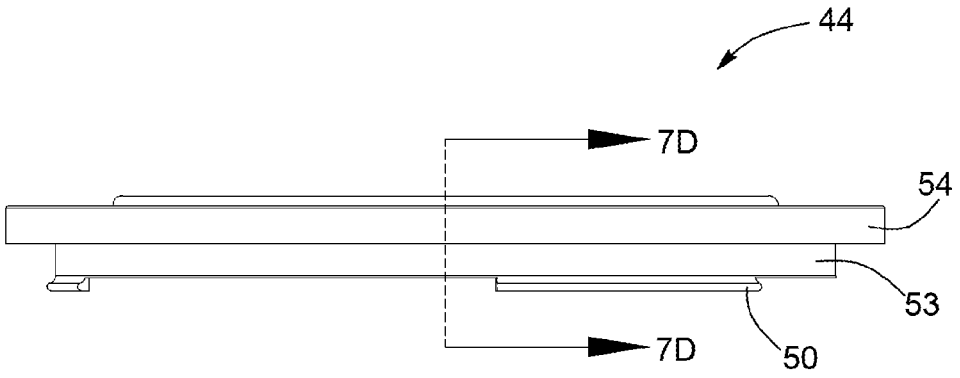
FIG. 7C is a side view of the additional framing element of FIG. 7A.
Figure 7D:
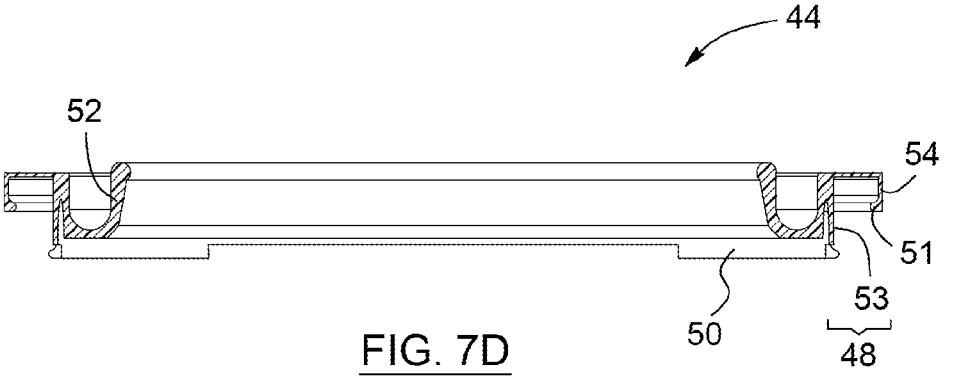
FIG. 7D is a cross-sectional view of the additional framing element of FIG. 7C, taken along line 7D-7D.
Figure 8A:
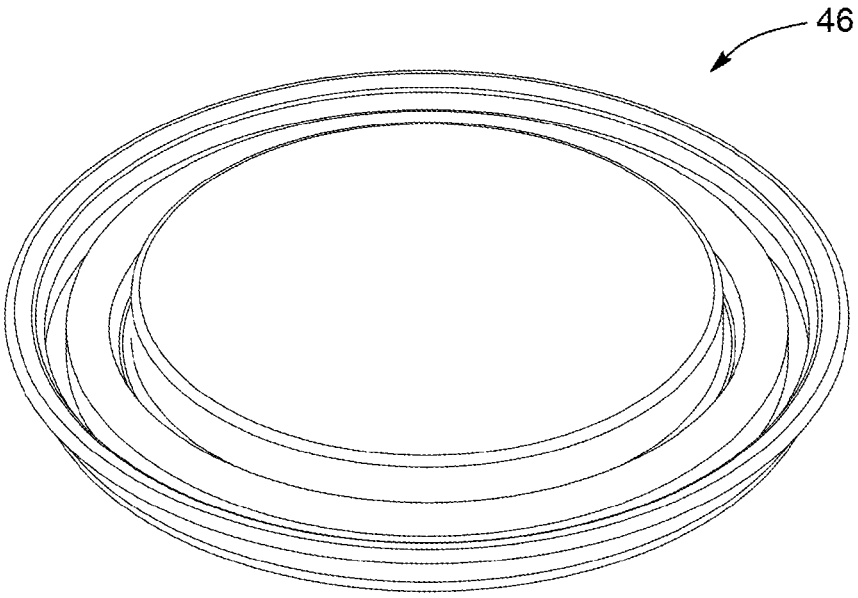
FIG. 8A is a top perspective view of a lid, according to a first variant.
Figure 8B:
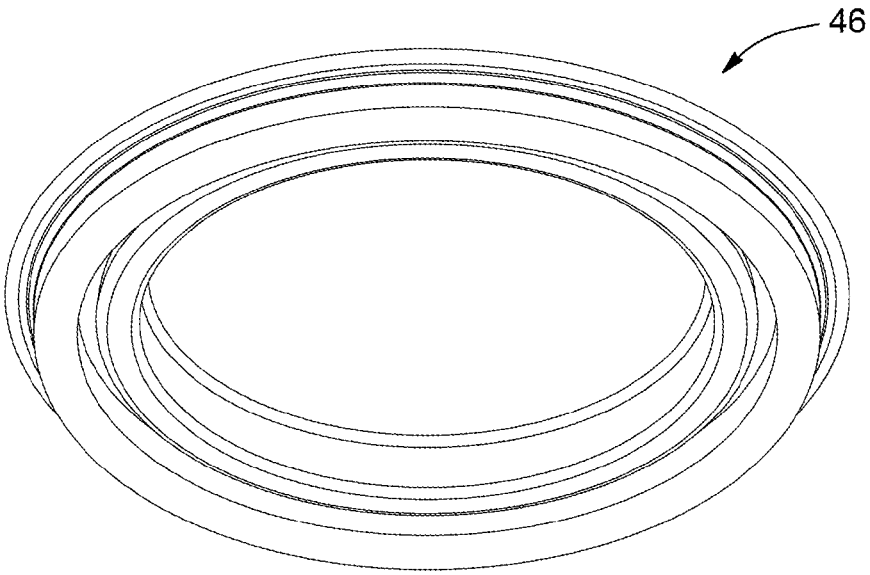
FIG. 8B is a bottom perspective view of the lid of FIG. 8A.
Figure 8C:
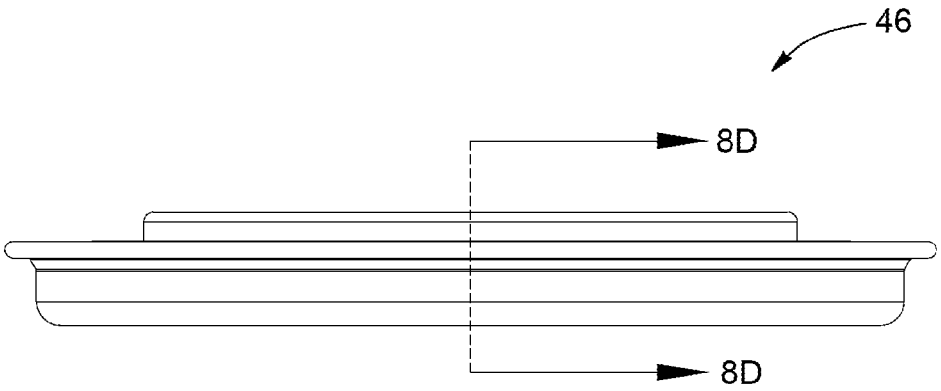
FIG. 8C is a side view of the lid of FIG. 8A.
Figure 8D:
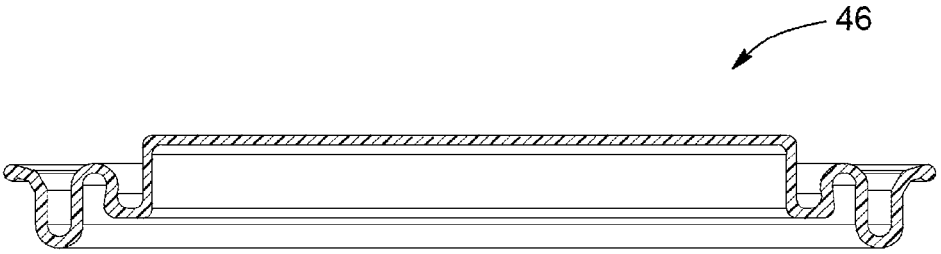
FIG. 8D is a cross-sectional view of the lid shown in FIG. 8C, taken along line 8D-8D.

With reference to FIG. 5D, and also to FIG. 7D, the outer wall 54 of the framing element 44 may also be provided with a locking rim or flange 51, which is also for interlocking or snapping to the collar of the framing element 28, and more specifically for interlocking with the underside of the peripheral wall 35 of the framing element 14.

Also, the lid receiving flange 52 extends from the collar 48 of this additional framing element 44, and receives the lid 46, which is illustrated in FIGS. 8A to 8D.

Now referring to FIGS. 9A to 9D, a third embodiment of the recyclable composite container 10 is shown. This embodiment of the container 10 also comprises a cardboard hollow body 12 with apertures 26, the apertures 26 in this case having a rectangular shape. A framing element 14 is provided with resilient arms 30, from which rectangular projections 32 protrude radially outward for fitting into the corresponding apertures 26. An impervious bag 42 is used to line the inner surface 22 of the cardboard hollow body 12, and an additional framing element 44 snaps to the framing element 14, thereby clamping the bag 42 between the two. The additional framing element 44 can also include a lid 46 to close off the container 10. In this embodiment of the container 10, another framing element 14 is used to close off the bottom open end 16 of the cardboard hollow body 12. As such, apertures 26 are provided on both sides of the body 12, the lower framing element 14 removably closing off the container 10 while the upper framing elements 14 and 44, and lid 46 removably close the container 10.

Figure 9A:
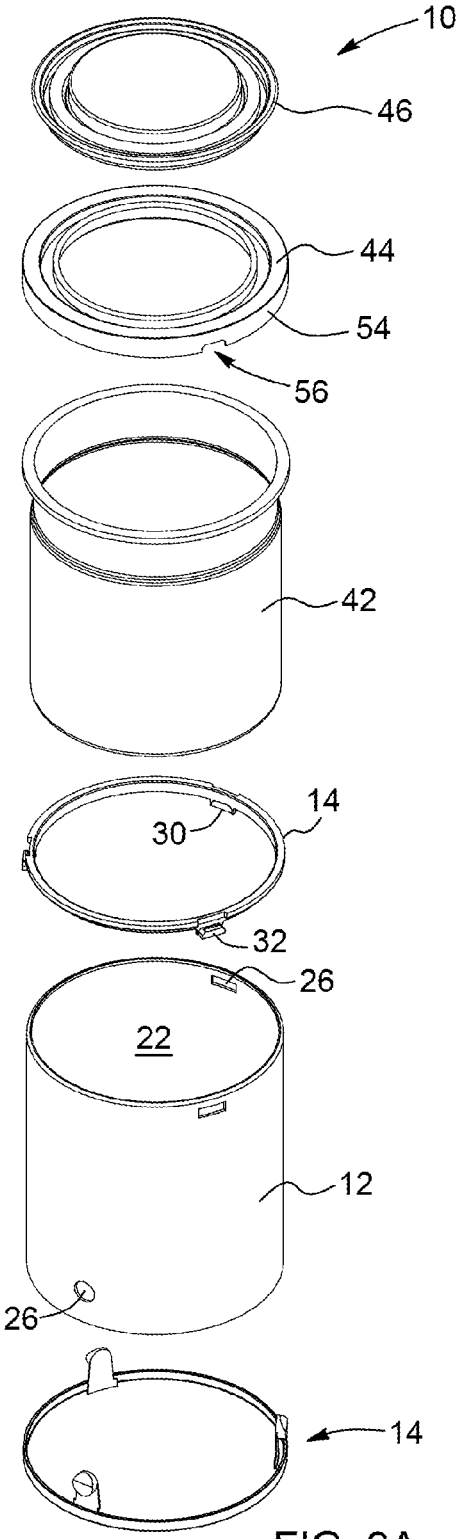
FIG. 9A is an exploded view of a container, according to a third preferred embodiment of the invention.
Figure 9B:
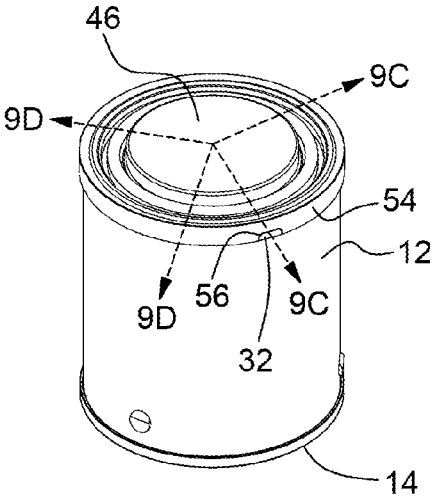
FIG. 9B is a top perspective view of the container of FIG. 9A, shown assembled.
Figure 9C:
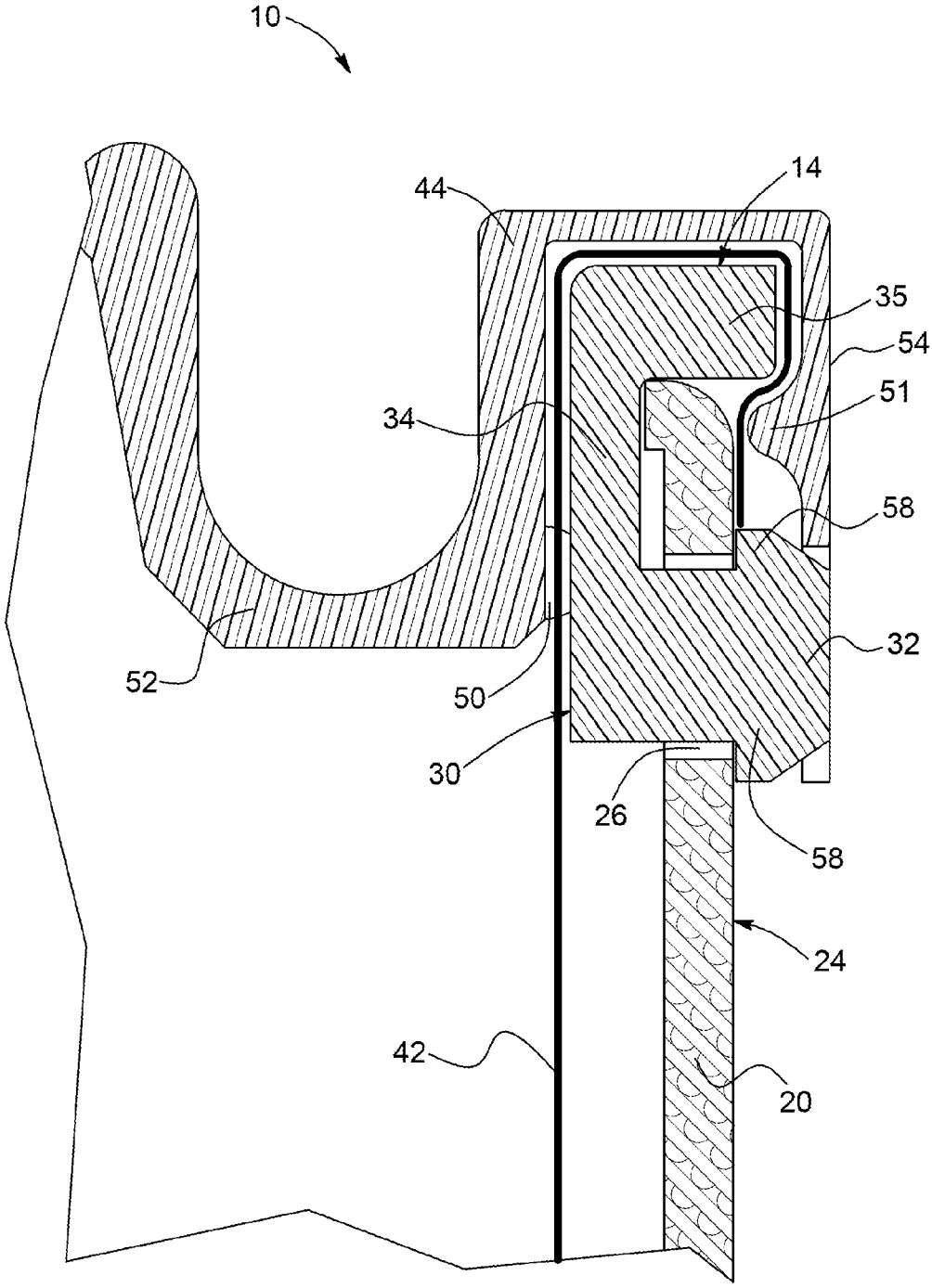
FIG. 9C is a partial cross-sectional view of the container of FIG. 9B, taken along line 9C-9C.
Figure 9D:
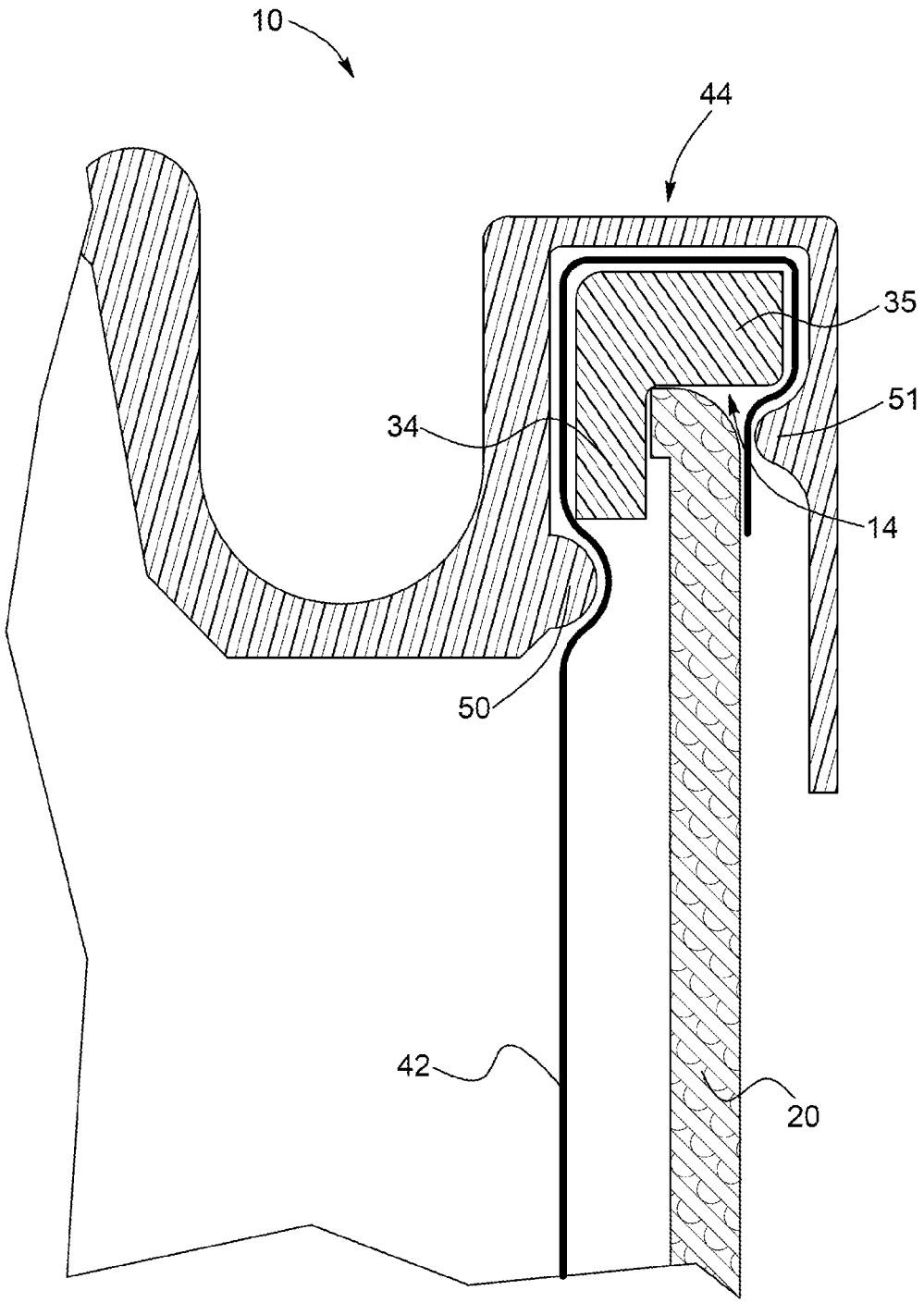
FIG. 9D is a partial cross-sectional view of the container of FIG. 9B, taken along line 9D-9D.
Figure 10A:
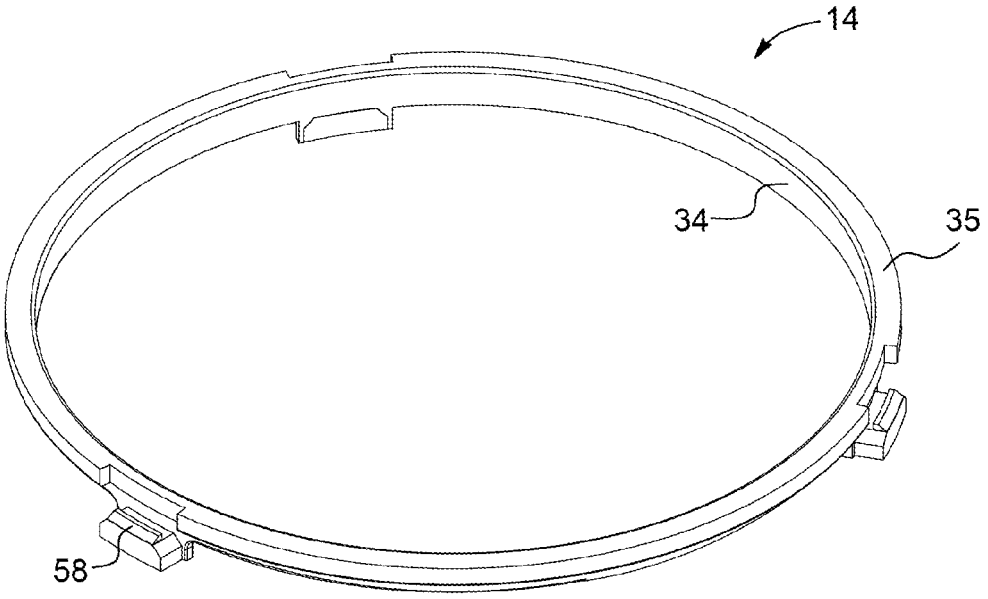
FIG. 10A is a top perspective view of a framing element, according to a fifth variant.
Figure 10B:
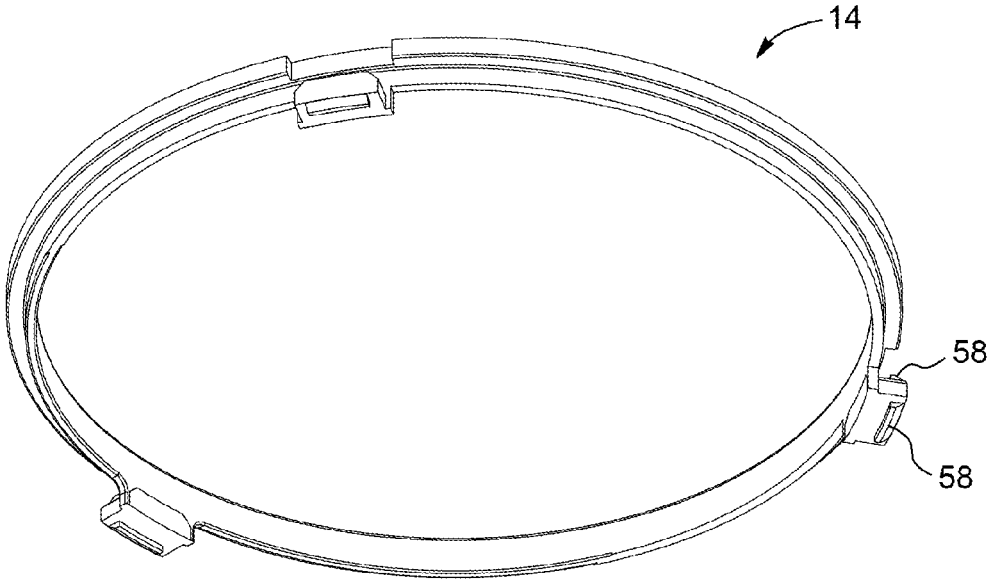
FIG. 10B is a bottom perspective view of the framing element of FIG. 10A.
Figure 10C:
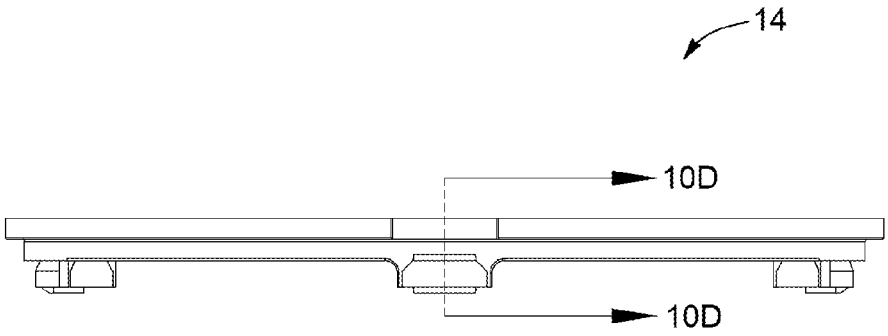
FIG. 10C is a side view of the framing element of FIG. 10A.
Figure 10D:
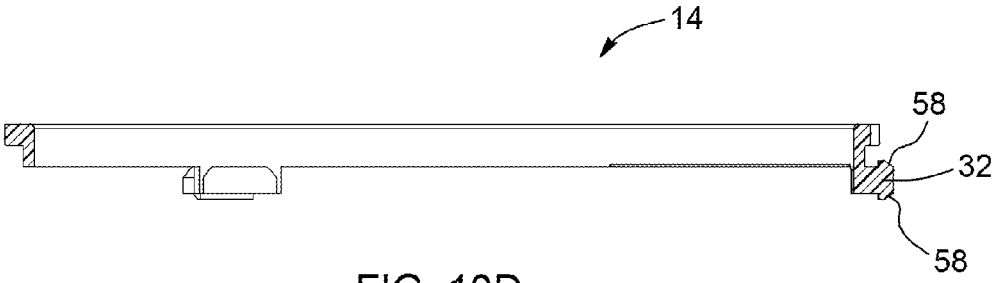
FIG. 10D is a cross-sectional view of the framing element of FIG. 10C, taken along line 10D-10D.

As shown in FIGS. 9C and 9D, and also in FIGS. 10A to 10D, this variant of the framing element 14 is provided with locking lips 58 on the protrusion 32, for engaging with the outer surface of the sidewall 20 bounding the aperture 26, when the projection 32 is fitted in it, allowing to reversibly lock the projection 32 within the aperture 26. Of course, different shapes of locking lips can be considered. The locking lip 58 advantageously provides a stronger connection of the framing element 14 with the cardboard body 12. While in FIGS. 10A and 10D the resilient arms 30 are shown shorter than in the other variants, they are still flexible enough to allow the projections 32 to be pressed in or out of their corresponding apertures 26. Of course, due to the nature of the cardboard 12, the area surrounding the aperture 26 can be slightly deformed when the protrusions 32 are pressed in or out, such as to allow engagement or disengagement of the protrusions 32 manually, that is by pressing with fingers projections 32 from within their apertures 26. This type of container configuration is devised to be assembled in the factory, when a substance is poured in the container, and dissembled when the end user has emptied the container and wants to recycle its components. Of course, in the case of paint containers for example, the containers can be brought in batches to a depot, where workers would disassemble the parts to sort and recycle them. The bags, depending on the type of substance it contained, can also be recycled.

Referring to FIGS. 11A to 11D, and also to FIGS. 9B and 9C, in this second variant of the additional framing element 44, the outer wall 54 of the U-shaped snapping collar 48 is provided with indentations 56, which are complementary to the projections 32 of the resilient arms 30. As shown in FIGS. 9B and 9C, the outer wall 54 extends at least up to the projection 32, the projection 32 being aligned with the indentation 56 when the framing element 14 is connected to the cardboard hollow body 12, and when the U-shaped snapping collar 48 of the additional framing element 44 is snapped on the framing element 14. As it can be appreciated, the U-shaped snapping collar 48 of this variant of the additional framing element 44 conceals the projection 32 within its outer wall 54. Of course, while in this variant, where the indentation 56 is flush with the projection 32, it is possible to have the outer wall 54 extend lower than the indentation 56, the indentation 56 in this case taking the form of a hole for providing access to the protrusion 32.

Figure 11A:
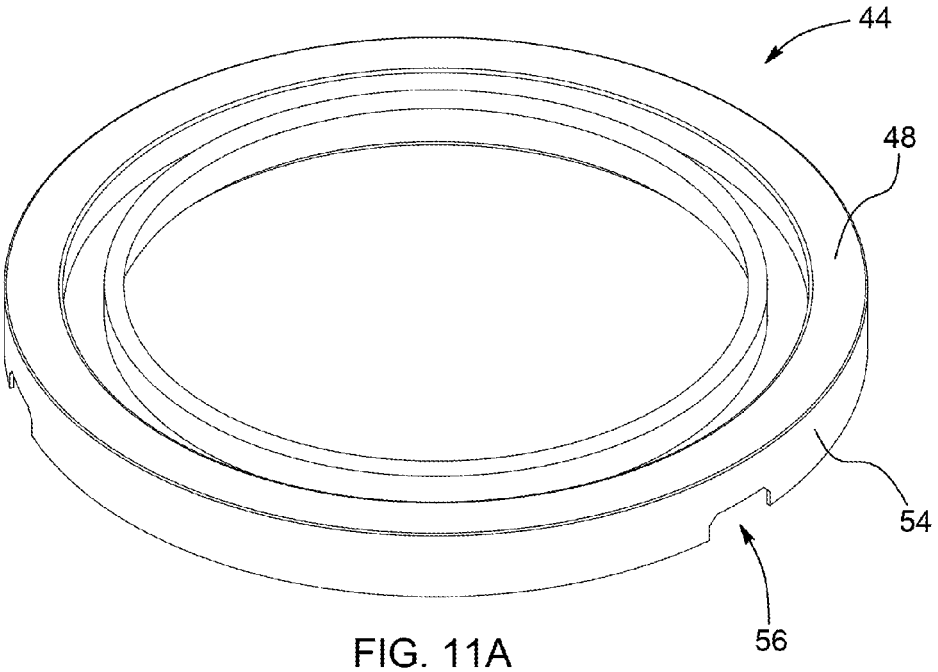
FIG. 11A is a top perspective view of an additional framing element, according to a second variant.
Figure 11B:
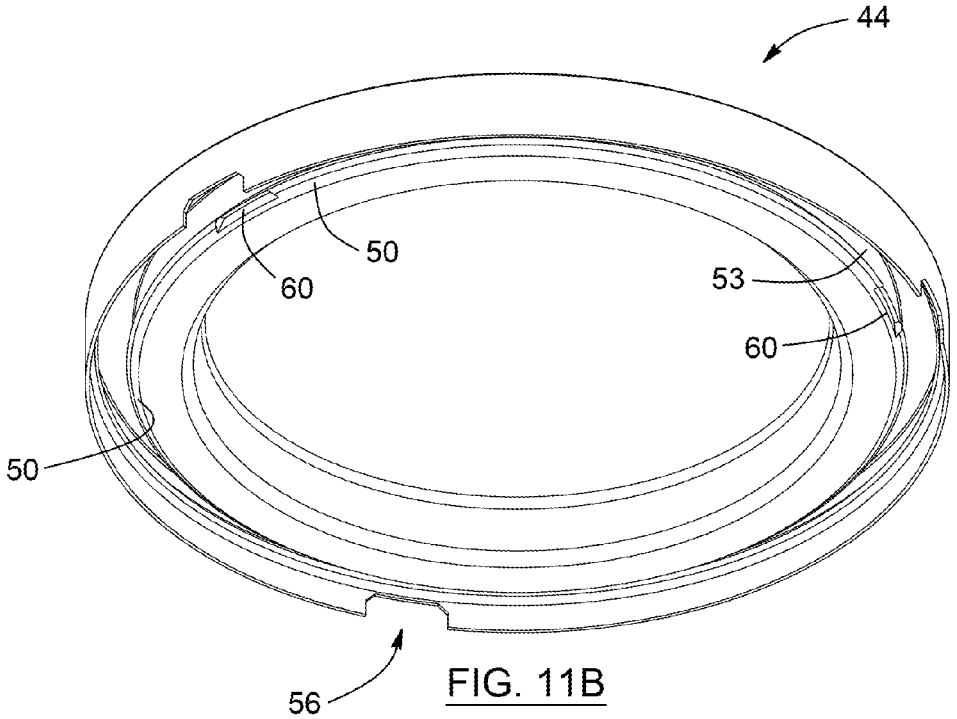
FIG. 11B is a bottom perspective view of the additional framing element of FIG. 11A.
Figure 11C:
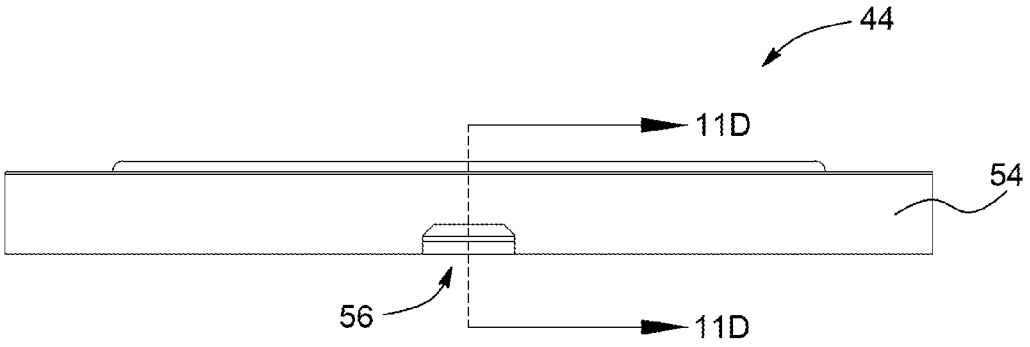
FIG. 11C is a side view of the framing element of FIG. 11A.
Figure 11D:
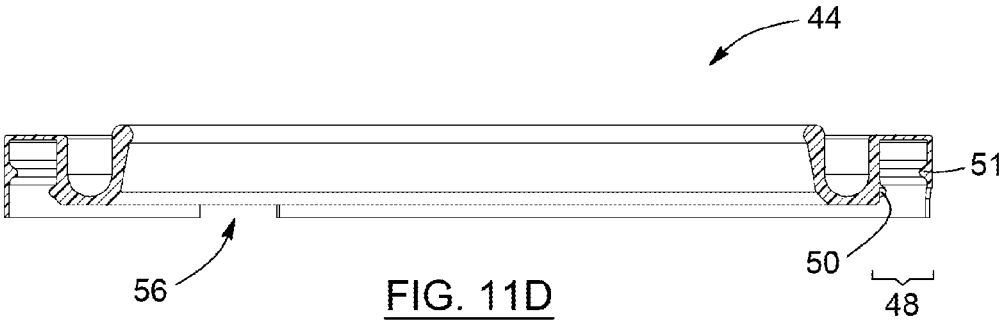
FIG. 11D is a cross-sectional view of the framing element of FIG. 11C, taken along line 11D-11D.

Referring to FIGS. 9C and 11B, the inner wall of the additional framing element 53 is also provided with notches 60 provided in the locking flange 50 so as to allow passage of the resilient arm 30 when the additional framing element 44 is snapped over the framing element 14. It should also be noted that in the variant of the additional framing element 44 shown in FIG. 11B, the locking flange 50 extends continuously along the inner wall 53.

Figure 12A:
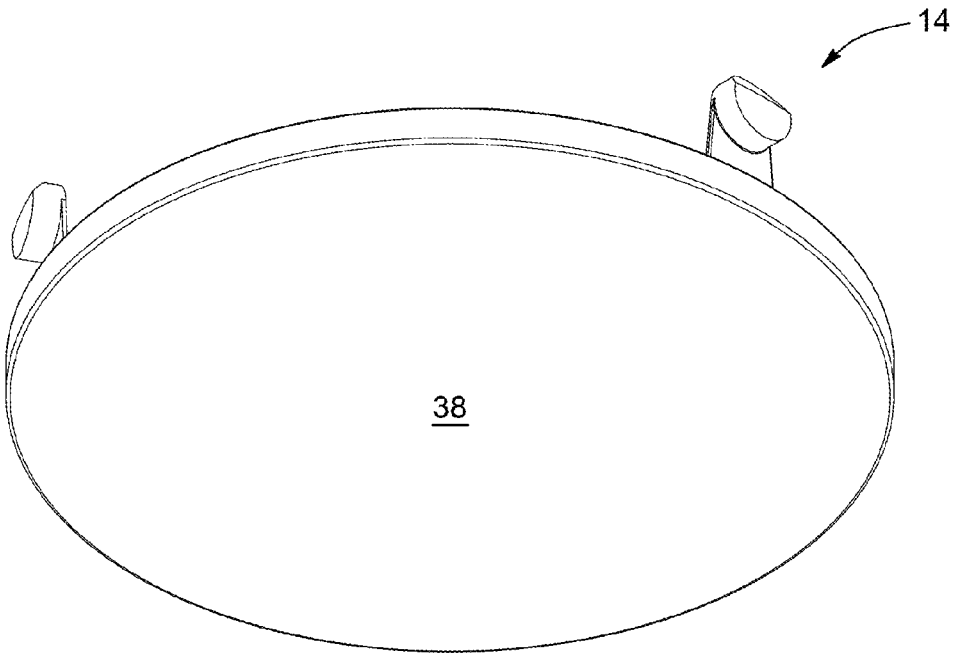
FIG. 12A is a bottom perspective view of a framing element, according to a sixth variant.
Figure 12B:
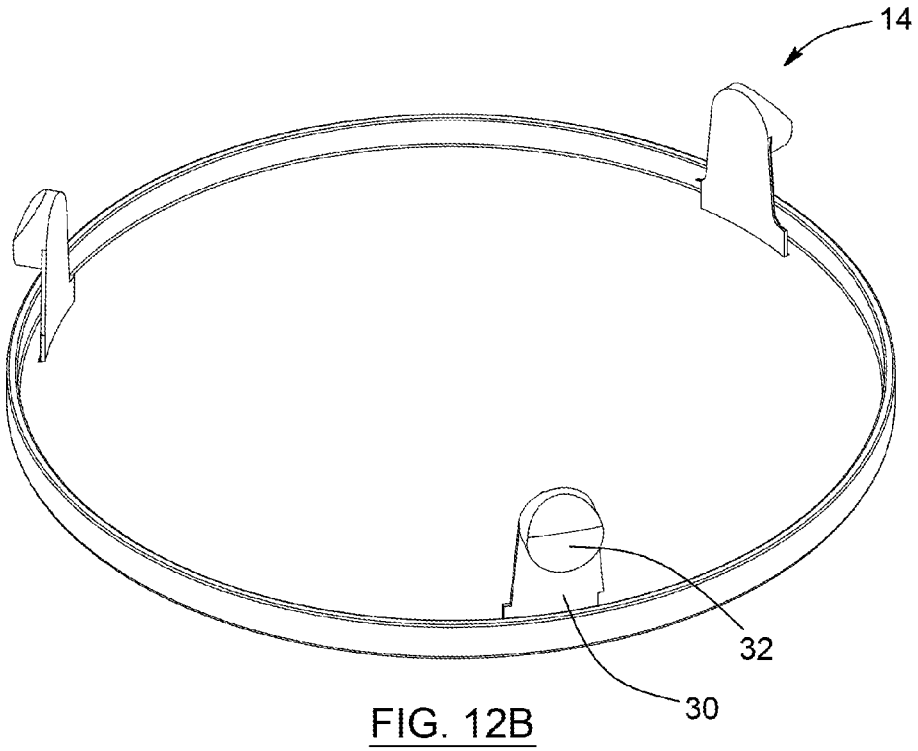
FIG. 12B is a top perspective view of the framing element of FIG. 12A.
Figure 12C:
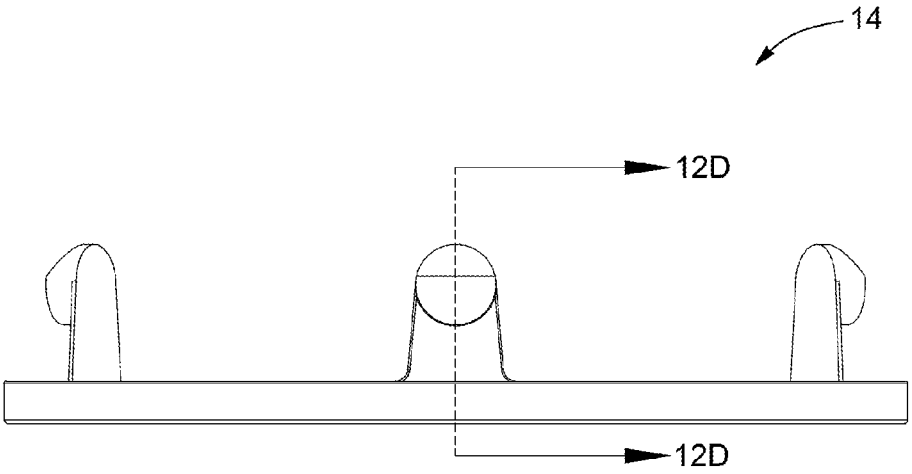
FIG. 12C is a side view of the framing element of FIG. 12A.
Figure 12D:
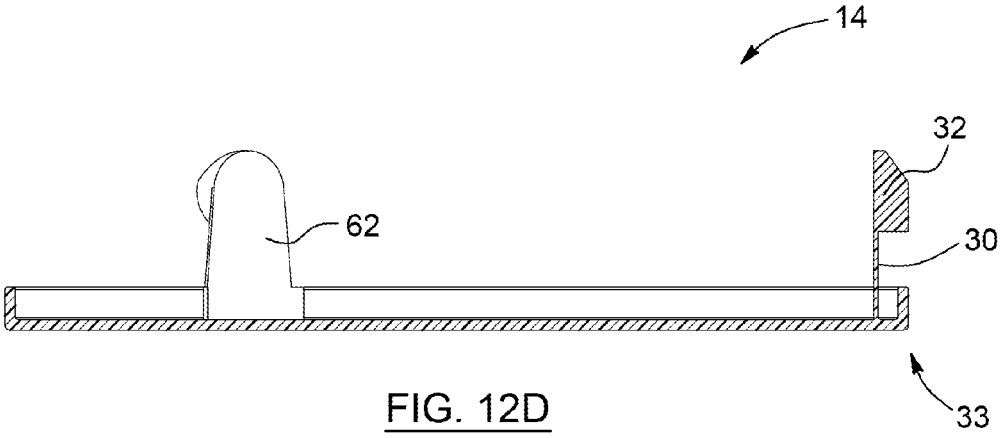
FIG. 12D is a cross-sectional view of the framing element of FIG. 12C, taken along line 12D-12D.

Now referring to FIGS. 12A to 12B, the bottom framing element 14 of the container 10 of FIG. 9A is shown. This variant of the framing element 14 includes a plurality of resilient arms 30 which are distributed along the collar 28, and is closed by a cover wall 38.

Referring to FIGS. 13A to 13D, a fourth preferred embodiment of a recyclable composite container 10 is shown. In this case, such container 10 can be used for containing substance such as silicone or acrylic caulking. The open end 16 of the bag 42 is placed at the bottom of the cardboard hollow body 12 such that the closed end is located towards the framing element 14 and is pierced right before use, as commonly known in the art, so as to allow the substance contained within the bag 42 to be expelled through the spout 64. The bag 42 is provided with a rim 66, and a bottom cover cap 15 closes off the bag 42 by clamping the bag 42 between said cover 15 and the bottom open end 16 of the cardboard hollow body 12. The upper side of the cardboard hollow body 12 is provided with two apertures 26 (only one being shown in FIG. 13A) sized and placed to receive the corresponding projections 32 of the resilient arms 30 of the framing element 14. A spout 64 can be screwed on the framing element 14.

Figure 13A:
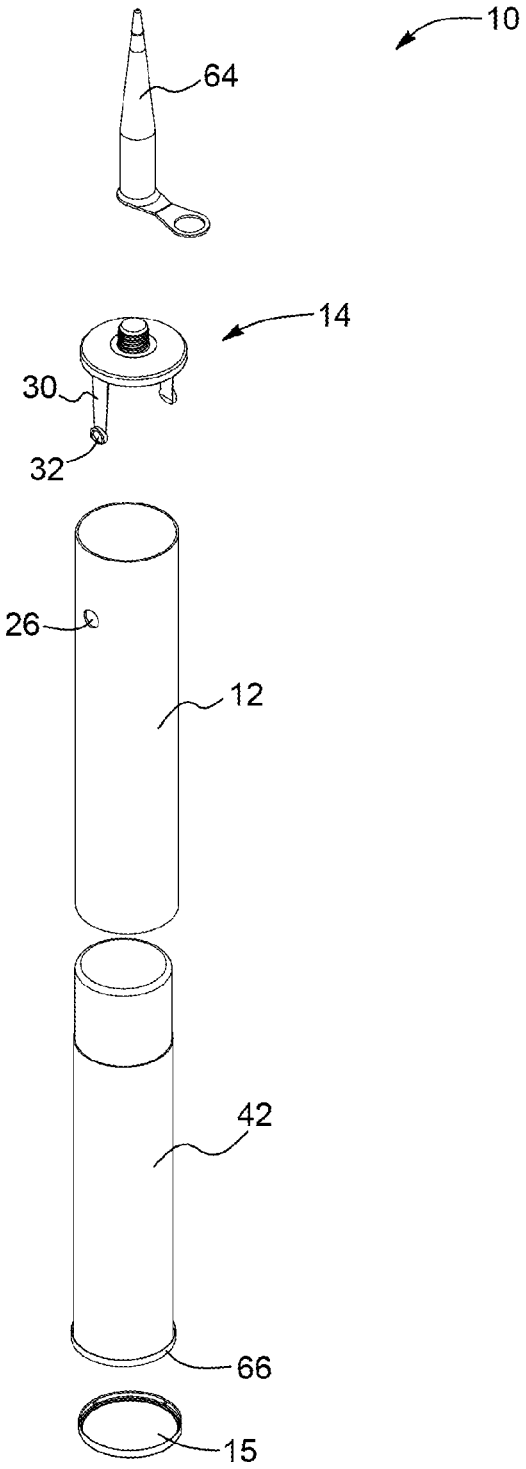
FIG. 13A is an exploded view of a container, according to a fourth preferred embodiment of the invention.
Figure 13B:
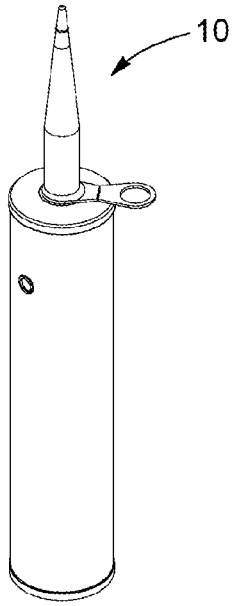
FIG. 13B is a top perspective view of the container of FIG. 13A, shown assembled.
Figure 13C:
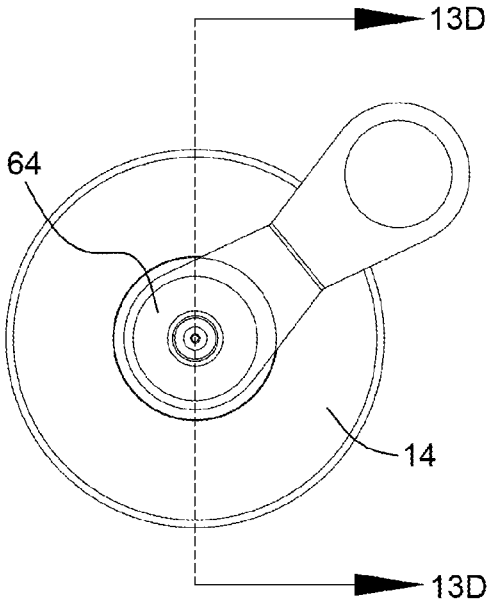
FIG. 13C is a top view of the container of FIG. 13B.
Figure 13D:
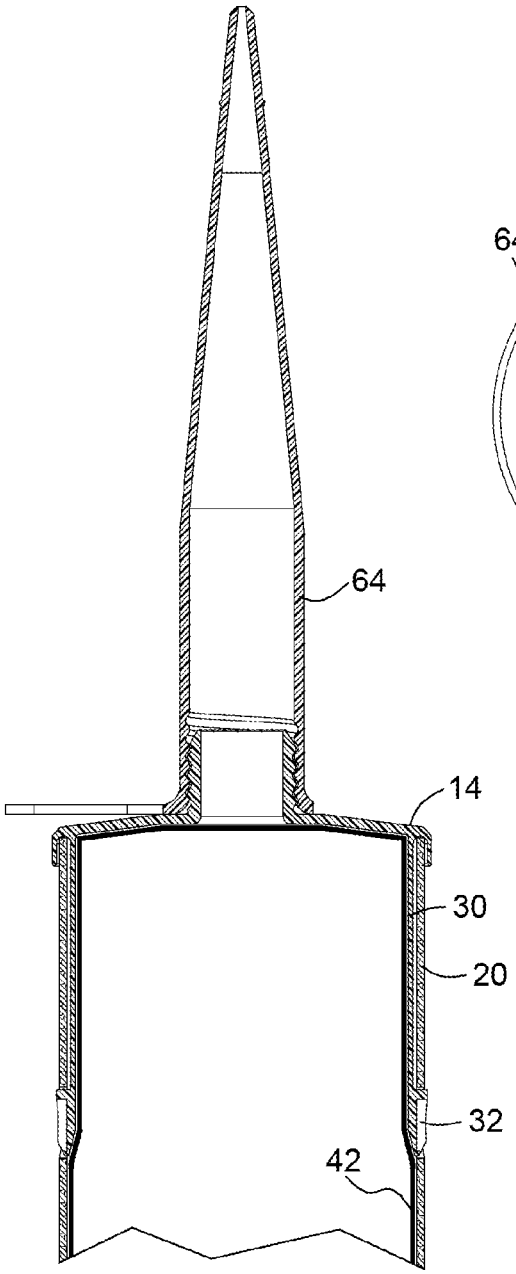
FIG. 13D is a cross-sectional view of the container of FIG. 13C, taken along line 13D-13D.
Figure 14A:
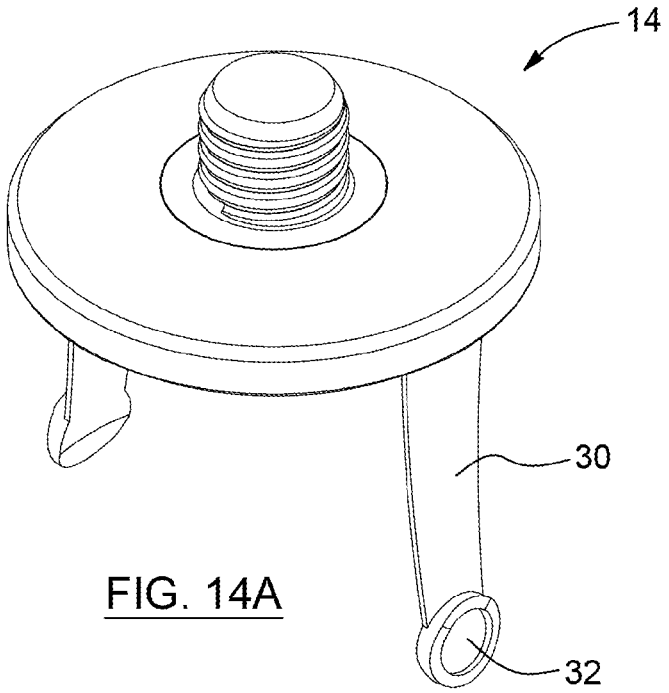
FIG. 14A is a top perspective view of a framing element, according to a seventh variant.
Figure 14B:
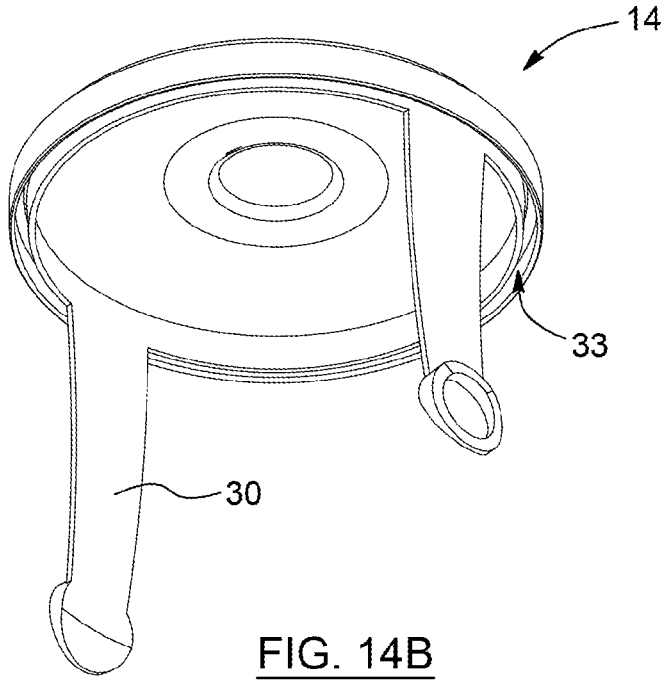
FIG. 14B is a bottom perspective view of the framing element of FIG. 14A.
Figure 14C:
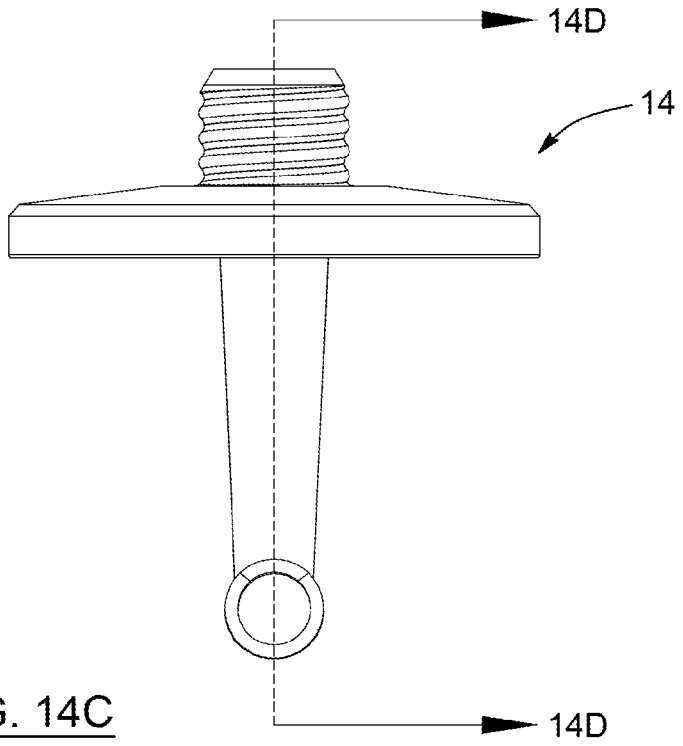
FIG. 14C is a side view of the framing element of FIG. 14A.
Figure 14D:
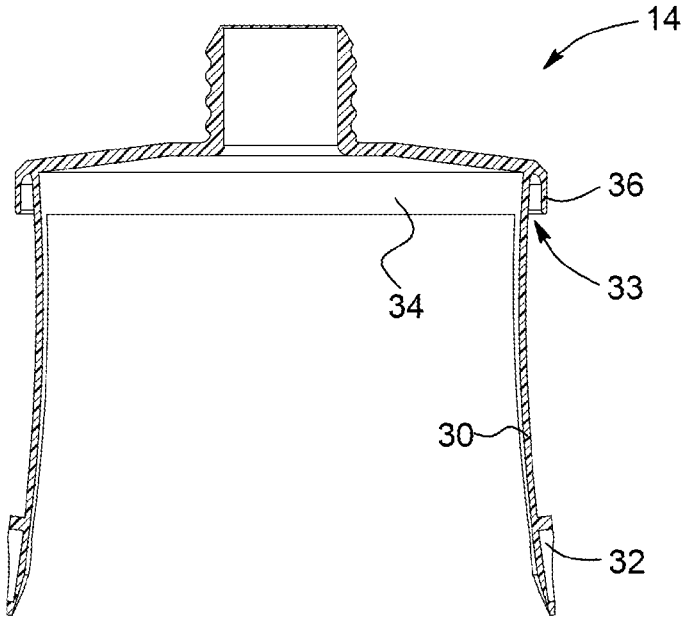
FIG. 14D is a cross-sectional view of the framing element of FIG. 14C, taken along line 14D-14D.
Figure 15A:
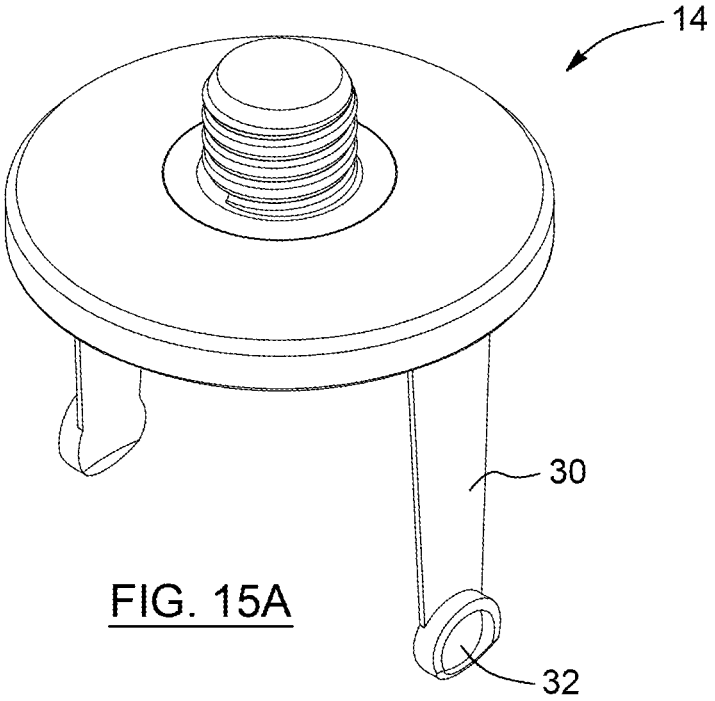
FIG. 15A is a top perspective view of a framing element, according to an eighth variant.
Figure 15B:
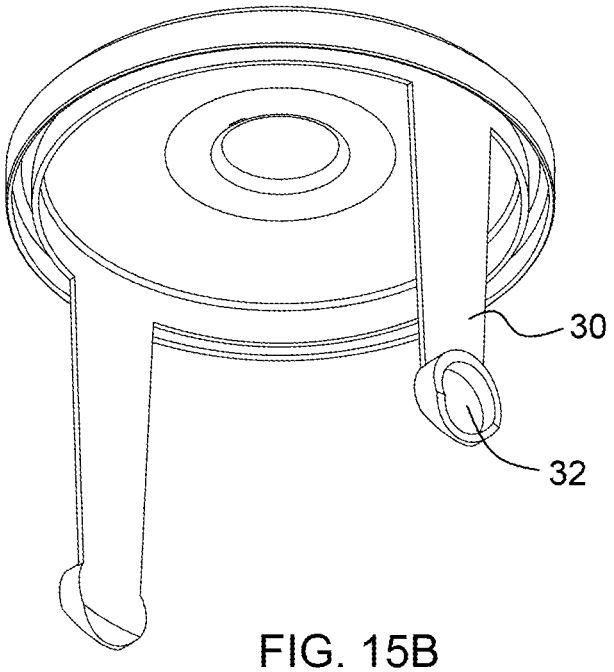
FIG. 15B is a bottom perspective view of the framing element of FIG. 15A.

The framing element 14 of FIG. 13A is shown in greater detail in FIGS. 14A to 14D. The resilient arms 30 are preferably outwardly curved, allowing, when in use, to bias the projections 32 within the apertures 26 of the framing element 14 when connected to the cardboard hollow body 12. It is also possible to have the resilient arms 30 be straight such as shown in FIGS. 15A and 15B. In either one of the variants shown in FIGS. 14A to 15B, the resilient arms 30 are longer than in previous variants, and they can extend on a longer portion of the inner surface 22 of the body 12.

Figure 16A:
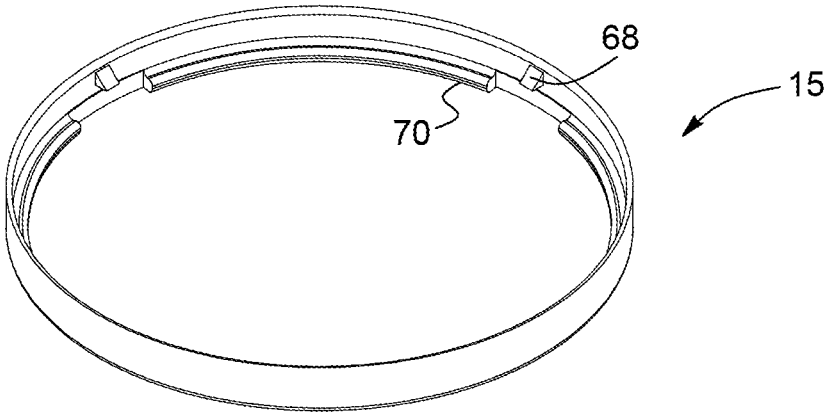
FIG. 16A is a top perspective view of a bottom cap.
Figure 16B:
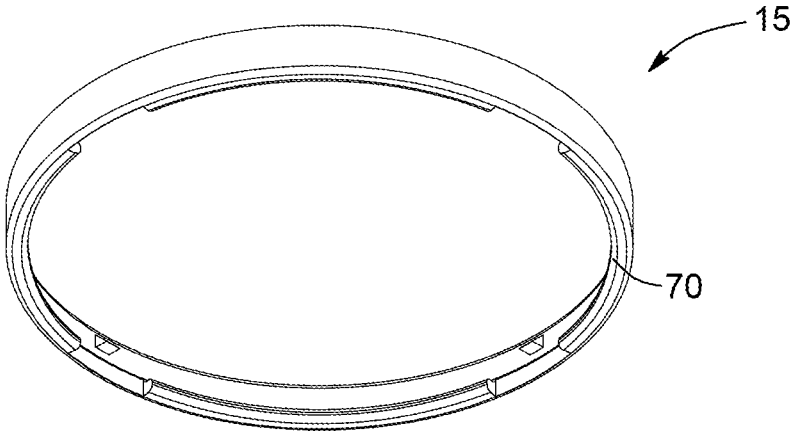
FIG. 16B is a bottom perspective view of the bottom cap of FIG. 16A.

Finally, with reference to FIGS. 16A and 16B, the bottom cover or cap 15 of the container of FIG. 13A is shown in greater detail, where it can be seen that the peripheral wall is provided with teeth 68 and inner flanges 70 for clamping both the bag 42 and the bottom portion of the sidewall 20 of the cardboard hollow body 12 when in use.

In sharp contrast with existing containers, both composite and not, it will be appreciated that a container system in accordance with the present invention advantageously requires no crimping, seaming, bonding or other permanent joining. The hollow body 12 can be connected to the framing element 14 via engagement of the aperture(s) 26 and the arm(s) 30 alone. As such, the container system can be easily disassembled after use. It will be appreciated that this ability to be disassembled advantageously enables the individual components (at least the hollow body 12 and the end framing elements 14, 44, and the bag 42 if present) to be separated and reused or recycled as appropriate. If the container system were filled with a non-recyclable substance such as paint, the plastic bag liner can be thrown out. The remainder, including the cardboard hollow body, would nonetheless be recyclable and/or reusable.

It will be appreciated that a container system in accordance with the present invention advantageously enables considerable weight savings compared to equivalently sized all-metal or all-plastic containers—up to 30% for an all-metal container. In addition, the present container system also enables considerable costs savings compared to conventional cardboard composite containers.

Although preferred embodiments of the present invention have been described in detail herein and illustrated in the accompanying drawings, it is to be understood that the invention is not limited to these precise embodiments and that various changes and modifications may be effected therein without departing from the scope of the present invention.

The invention claimed is:

1. A recyclable composite container comprising:

a cardboard hollow body having an open end defining an opening, the body being formed by a sidewall having inner and outer surfaces, the sidewall being provided with an aperture at a distance from the open end;

a first framing element made of plastic and removably connected to the open end of the cardboard hollow body via a non-crimped connection, the first framing element having a central aperture and comprising:

a collar snugly fitting over said open end of the cardboard hollow body, the collar having:

a peripheral wall resting on an end surface of the sidewall; and an inner wall extending from the peripheral wall, sized and shaped to hug the inner surface of the sidewall when the framing element is connected to the cardboard hollow body; and a resilient arm integrally formed as part of the first framing element, and extending below the inner wall along the inner surface of the sidewall and having a projection removably fitted in the aperture of the sidewall of the hollow body;

an additional framing element made of plastic, snapped over the collar of the first framing element, the additional framing element comprising a U-shaped snapping collar with a central aperture aligned with the central aperture of the collar of the first framing element and parallel inner and outer walls clamping the collar of the first framing element, the inner and outer walls being provided with locking flanges interlocked with the collar of the first framing element; and a cover removably attached to the additional framing element; and an impervious bag lining the inner surface of the sidewall of the cardboard hollow body, the bag having an open end clamped between the collar of the first framing element and the U-shaped snapping collar of the additional framing element, the open end of the bag being clamped independently of the cover and being at least partially folded around the first framing element.

2. The recyclable composite container according to claim 1, wherein the projection of the resilient arm has a locking lip engaging the outer surface of the sidewall when the projection is fitted in the aperture of the sidewall, thus reversibly locking the projection within the aperture.

3. The recyclable composite container according to claim 1, wherein the additional framing element comprises a lid, and the U-shaped snapping collar of the additional framing element is provided with a lid receiving flange sealingly and removably receiving the lid.

4. The recyclable composite container according to claim 1, wherein the outer wall of the U-shaped snapping collar has an indentation complementary to the projection of the resilient arm, and wherein said outer wall extends at least up to said projection, the projection of the resilient wall being aligned with the indentation of the outer wall of the U-shaped snapping collar when the first framing element is connected to the cardboard hollow body and when the U-shaped snapping collar is snapped on the first framing element, the U-shaped snapping collar thereby concealing the projection within its outer wall.

5. The recyclable composite container according to claim 1, wherein the additional framing element comprises a cover wall integral to the U-shaped snapping collar closing the opening of the cardboard hollow body when the additional framing element is connected to the open end.

6. The recyclable composite container according to claim 1, wherein the resilient arm is outwardly curved, biasing the projection within the aperture when the first framing element is connected to the cardboard hollow body.

7. The recyclable composite container according to claim 1, wherein the cardboard hollow body comprises a plurality of said aperture and the first framing element comprises a plurality of said resilient arm, the projection of each of said resilient arms fitting in one of said apertures when the first framing element is connected to the cardboard hollow body.

8. The recyclable composite container according to claim 1, wherein the aperture in the sidewall and the projection of the resilient arm have a disk shape.

9. The recyclable composite container according to claim 1, wherein the aperture in the sidewall and the projection of the resilient arm have a substantially rectangular shape.

10. The recyclable composite container according to claim 1, wherein the impervious bag is clamped simultaneously by both of the locking flanges.

11. The recyclable composite container according to claim 1, further comprising a lower end framing element removably connected to an open end of the cardboard hollow body opposite the first framing element.

12. The recyclable composite container according to claim 11, wherein the lower end framing element is a cap.

13. The recyclable container according to claim 11, wherein the impervious bag is vacuum-sealed to the inner surface of the cardboard hollow body.

14. The recyclable container according to claim 1, wherein the first framing element and the additional framing elements are removably connected to one another.

15. The recyclable container according to claim 1, wherein the first framing element, additional framing element and bag together form a disposable assembly, the disposable assembly being removable from the cardboard hollow body without unclamping the open end of the bag from between the collar of the first framing element and the U-shaped snapping collar of the second framing element.

* * * * *